US007083471B2

(12) United States Patent
Hayashi

(10) Patent No.: US 7,083,471 B2
(45) Date of Patent: Aug. 1, 2006

(54) CONNECTING STRUCTURE OF CONNECTOR, SHIELD CONNECTOR AND LEVER TYPE CONNECTOR

(75) Inventor: Hiroyuki Hayashi, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/867,703

(22) Filed: Jun. 16, 2004

(65) Prior Publication Data

US 2004/0266265 A1 Dec. 30, 2004

(30) Foreign Application Priority Data

Jun. 18, 2003 (JP) ..... 2003-173796
Jun. 18, 2003 (JP) ..... 2003-173797
Jun. 18, 2003 (JP) ..... 2003-173798

(51) Int. Cl.
*H01R 9/03* (2006.01)

(52) U.S. Cl. ..... 439/610; 439/341; 439/159; 439/164

(58) Field of Classification Search ..... 439/157, 439/159–160, 164, 341–342, 610
See application file for complete search history.

(56) References Cited

U.S. PATENT DOCUMENTS 6,135,818 A * 10/2000 Lang et al. ..... 439/610
6,142,787 A * 11/2000 Ikesugi ..... 439/15
6,652,298 B1 * 11/2003 Ohnuki ..... 439/157

FOREIGN PATENT DOCUMENTS

JP A-11-26093 1/1999
JP A-2001-237026 8/2001

* cited by examiner

*Primary Examiner*—Truc Nguyen
(74) *Attorney, Agent, or Firm*—Oliff & Berridge, PLC

(57) ABSTRACT

A connecting structure of a connector includes: a first connector having a housing for containing a plurality of terminal metal pieces connected to a plurality of wires, a shield shell including a hood portion projected to a front side and surrounding the housing, and a shield member connected with the shield shell and surrounding the plurality of the wires; and a second connector capable of being fitted to the first connector, the second connector having a housing capable of containing a plurality of terminal metal pieces and capable of being fitted to the housing of the first connector and a shield shell surrounding the housing. At least one of the shield shell of the first connector and the shield shell of the second connector is made by diecasting.

14 Claims, 16 Drawing Sheets

CONNECTING STRUCTURE OF CONNECTOR, SHIELD CONNECTOR AND LEVER TYPE CONNECTOR

BACKGROUND OF THE INVENTION

1. Field of the Invention

The present invention relates to a connecting structure of a connector, a shield connector and a lever type connector.

2. Description of the Related Art

There is a shield connector for connecting a plurality of pieces of shield wires to an apparatus of an inverter apparatus or the like in, for example, an electric car having a structure for providing apparatus side terminals at inside of a shield case of the apparatus, opening attaching holes in correspondence with the respective apparatus side terminals at the shield case, respectively inserting wire side terminals fixedly attached to distal ends of the respective shield wires into the attaching holes to connect to the apparatus side terminals, and respectively connecting distal end portions of shield members of the respective shield wires to the shield case (refer to, for example, JP-A-11-26093).

Conventionally, there is a lever type connector in which a lever made of a synthetic resin is pivotably supported by a connector housing made of a synthetic resin for containing a terminal metal piece, and by pivoting the lever in a state of engaging a cam follower of a counter side connector housing to a cam groove of the lever, the lever type connector attracts to fit to the counter side connector housing. In a state of fitting the two connector housings, the lever is restricted from being pivoted by engaging a lock portion formed at the lever and a lock portion formed at the connector housing and the two connector housings are locked in a fitted state by restricting the lever from being pivoted. JP-A-2001-237026 discloses one example of such a lever type connector.

SUMMARY OF THE INVENTION

However, according to the shield connector, operation of attaching the wire side terminals to the attaching holes and operation of connecting the shield members to the shield case need to repeat respectively by a number of times the same as a number of poles of the terminals (that is, number of pieces of shield wires) and therefore, there poses a problem that time and labor are taken.

The invention has been created in view of the above-described situation and it is an object of the invention to promote operability of attaching to a connection counterpart.

Also, in the above-described conventional lever type connector, both of the connector housing and the lever are made of a synthetic resin and therefore, it is easy to form the lock portions having comparatively complicated shape. However, in the case of a connector in which a connector housing is surrounded by a diecast part (for example, shield shell), in consideration of cost of a die, there is a problem that it is difficult to form a lock portion having a complicated shape on a side of an outer face of the diecast part.

The invention has been made in view of the above-described situation and it is an object of the invention to be able to lock a lever in a state of restricting rattling thereof even when a complicated lock portion cannot be formed at a member supporting the lever.

According to a first aspect of the invention, there is provided a connecting structure of a connector, comprising: a first connector having a housing for containing a plurality of terminal metal pieces connected to a plurality of wires, and a shield shell including a hood portion projected to a front side and surrounding the housing, the shield shell is connected with a shield member surrounding the plurality of wires; and a second connector capable of being fitted to the first connector, the second connector having a housing capable of containing a plurality of terminal metal pieces and capable of being fitted to the housing of the first connector and a shield shell surrounding the housing; wherein at least one of the shield shell of the first connector and the shield shell of the second connector is made by diecasting; and wherein one of the shield shells of the first connector and the second connector is fitted to the other of the shield shells to be along an inner periphery or an outer periphery of the other of the shield shells in a state that the first connector and the second connector are fitted to each other.

According to a second aspect of the invention, the housing surrounded by the shield shell made by diecasting is provided with an rattling restricting portion capable of restricting the housing from being rattled in a direction intersecting with a direction of drawing a die relative to the shield shell by being brought into contact with a position of the inner periphery of the shield shell having a highest dimensional accuracy in the direction of drawing the die for diecasting in the structure of the first aspect.

According to a third aspect of the invention, the shield shell of the first connector and the shield shell of the second connector are conductively fixed by a bolt in a direction intersecting with a direction of fitting the two shield shells in the structure of the first or second aspect.

According to a fourth aspect of the invention, a lever is supported by either one of the shield shells of the first connector and the second connector and other of the shield shells is provided with a cam follower, and the two connectors are fitted to each other by pivoting the lever to a fitting position in a state of engaging the cam follower to a cam groove of the lever, wherein the cam groove is formed with a lock portion for restricting the cam follower from being displaced in a returning direction thereof by being engaged with the cam follower in a state that the lever is moved to the fitting position in the structure of any one of the first to third aspects.

According to a fifth aspect of the invention, there is provided a shield connector to be integrated to a counter side connector including a counter side housing for containing a plurality of counter side terminals and a counter side shield shell surrounding the counter side housing, the shield connector comprising: a housing for containing a plurality of terminal metal pieces connected to a plurality of wires; and a shield shell made by diecasting including a hood portion projected to a front side and surrounding the housing, the shield shell is connected with a shield member surrounding the plurality of wires; wherein in a state of being connected to the counter side connector, one of the shield shell and the counter side shield shell is fitted to the other to be along an inner periphery or an outer periphery of the other.

According to a sixth aspect of the invention, the housing is provided with an rattling restricting portion capable of restricting the housing from being rattled in a direction intersecting with a direction of drawing a die relative to the shield shell by being brought into contact with a position of the inner periphery of the shield shell having a highest dimensional accuracy in the direction of drawing the die for diecasting in the shield connector of the fifth aspect.

According to a seventh aspect of the invention, the shield shell and the counter side shield shell are conductively fixed by a bolt in a direction intersecting with a direction of fitting the two shield shells in the shield connector of the fifth or sixth aspect.

According to an eighth aspect of the invention, a lever is supported by the shield shell, the shield connector is connected to the counter side connector by pivoting the lever to a fitting position in a state of engaging a cam follower provided at the counter side shield shell to a cam groove of the lever, and the cam groove is formed with a lock portion for restricting the cam follower from being displaced in a returning direction thereof by being engaged with the cam follower in a state that the lever is moved to the fitting position in the shield connector of any one of fifth to seventh aspects.

According to a ninth aspect of the invention, there is provided a shield connector comprising: a housing for containing a plurality of terminal metal pieces connected to a plurality of wires; and a shield shell made by diecasting constituting a cylindrical shape and integrated to surround the housing; wherein the shield shell is connected with a distal end portion of a shield member surrounding the plurality of wires; and wherein the housing is provided with an rattling restricting portion capable of restricting the housing from being rattled in a direction intersecting with a direction of drawing a die relative to the shield shell by being brought into contact with an inner periphery of the shield shell.

According to a tenth aspect of the invention, the shield member is connected to an outer periphery of the shield shell by calking, a position of bringing the rattling restricting portion into the contact therewith is set at a position deviated from a region of calking the shield member in the shield connector of the ninth aspect.

According to an eleventh aspect of the invention, the shield shell is formed with a stepped difference portion an inner diameter dimension of which is changed in a shape of a stepped difference and the rattling restricting portion is brought into contact with the stepped difference portion in a direction substantially in parallel with the direction of drawing the die in the shield connector of the ninth or tenth aspect.

According to a twelfth aspect of the invention, the shield connector is fitted to a counter side connector constituted by surrounding a counter side housing containing a counter side terminal by a counter side shield shell; the shield shell is formed with a hood portion extended frontward from a position of bringing the rattling restricting portion into contact therewith; and a portion thereof connected to the counter side connector is shielded by fitting the hood portion to the counter side shield shell in the shield connector of any of the ninth to eleventh aspects.

According to a thirteenth aspect of the invention, there is provided a lever type connector comprising: a first connector having a housing for containing a terminal metal piece and a shield shell made by diecasting for surrounding the housing; a lever supported by the shield shell in a movable manner, the lever having a cam groove; and a second connector having a cam follower; wherein by moving the lever to a fitting position in a state of engaging the cam follower with the com groove, the second connector is attracted to the first connector to fit the two connectors to each other; and wherein the cam groove is formed with a lock portion for restricting the cam follower from being displaced in a returning direction thereof by being engaged with the cam follower in a state that the lever is at the fitting position.

According to a fourteenth aspect of the invention, the cam groove includes a first side face with which the cam follower is brought into sliding contact in accordance with pivoting the lever from the fitting position to a side of an initial position, the first side face being extended substantially linearly from an inlet of the cam groove to a depth end portion of the cam groove in the thirteenth aspect.

According to a fifteenth aspect of the invention, the second connector has a housing for containing a terminal metal piece and a shield shell for surrounding the housing and the shield shell is formed with the cam follower; and wherein in a state that the two connectors are fitted, either one of the shield shell of the first connector and the shield shell of the second connector overlaps to surround other thereof and the two fitted shield shells are conductively fixed by a bolt in a direction substantially orthogonal to a fitting direction in the fourteenth aspect.

According to a sixteenth aspect of the invention, the cam groove includes a second side face with which the cam follower is brought into sliding contact in accordance with pivoting the lever from a side of an initial position to the fitting position, the second side face having substantially an arc shape and formed with the lock portion in the thirteenth aspect.

According to a seventeenth aspect of the invention, the lock portion is located in the vicinity of a depth end portion of the cam groove in the sixteenth aspect.

According to an eighteenth aspect of the invention, the lock portion has substantially a triangular shape in the seventeenth aspect.

[Operation and Effect of the Invention]

[First Aspect of the Invention]

In integrating the two connectors, the shield shells may be fitted to each other simultaneously with fitting the housings and therefore, the fitting can be carried out by operation in one action. Further, a portion of fitting the shield shells is shielded by a double structure overlapped inside and outside and therefore, a high shielding effect is achieved. Further, by making the shield shell by diecasting, strength of the shield shell can be increased.

[Second and Sixth Aspects of the Invention]

Although the inner periphery of the shield shell needs to form in a taper shape in order to smoothly draw the die for diecasting, in forming the taper face, a dimension of the inner periphery of the shield shell is varied and therefore, it is unavoidable that the housing is rattled relative to the shield shell.

Hence, according to the invention , attention is paid to the face that the inner periphery of the shield shell can be set with the position having the highest dimensional accuracy in the direction of drawing the die for diecasting, and the housing is provided with the rattling restricting portion brought into contact with the position having the highest dimensional accuracy. Thereby, the housing can be restrained from being rattled in the direction of intersecting with the direction of drawing the die relative to the shield shell.

[Third and Seventh Aspects of the Invention]

The shield shells are fixed conductively by the bolt and therefore, reliability of a shielding function is promoted and the two connectors can firmly be locked in a fitted state.

[Fourth and Eighth Aspects of the Invention]

When the lever is moved to the fitting position, the cam follower is restricted from moving in the returning direction by engaging the cam follower to the lock portion. Thereby, also the lever is restricted from moving in the returning direction and the lever is locked to the fitting position. Since the lever is restricted from moving by engaging the lock portion provided at the cam groove and the cam follower and therefore, the lock portion may not be formed at the shield shell supporting the lever.

[Fifth Aspect of the Invention]

In being integrated to the counter side connector, the shield shell may be fitted to the counter side shield shell simultaneously with fitting the housing to the counter side housing and therefore, the fitting can be carried out by operation in one action. Further, the portion of fitting the shield shells can be shielded by a double structure overlapped inside and outside and therefore, a high shielding effect is achieved. Further, strength of the shield shell can be increased by making the shield shell by diecasting.

[Ninth Aspect of the Invention]

In being integrated to a connection counterpart of an apparatus or the like, the shield shells and the housings can be connected in one action. Further, since the shield shell is made by diecasting, strength thereof can be increased.

Meanwhile, in order to smoothly draw the die for diecasting, it is necessary to form an inner periphery of the shield shell by a taper face, and in forming the taper face, a dimension of the inner periphery of the shield shell is varied and therefore, it is unavoidable that the housing is rattled relative to the shield shell.

Hence, according to the invention, the rattling restricting portion capable of being brought into contact with the inner periphery of the shield shell is provided at the housing and by bringing the rattling restricting portion into contact therewith, the housing is restrained from being rattled in a direction of intersecting with the direction of drawing the die relative to the shield shell.

Further, attention is paid to the fact that with regard to the position of bringing the rattling restricting portion into contact therewith, a position in the direction of drawing the die for diecasting having the highest dimensional accuracy can be set and the rattling restricting portion can be brought into contact with the position having the highest dimensional accuracy.

[Tenth Aspect of the Invention]

The shield member is connected to the shield shell by calking and therefore, operability is more excellent than that of a connecting method using a bolt. Further, the rattling restricting portion is brought into contact with the position deviated from the calking region and therefore, even when the shield shell is deformed to contract a diameter thereof by calking, a function of restraining rattling by bringing the rattling restricting portion into contact therewith is not hampered.

[Eleventh Aspect of the Invention]

By bringing the rattling restricting portion into contact therewith in the direction substantially in parallel with the direction of drawing the die, the housing can be prevented from being idled in the direction of drawing the die relative to the shield shell.

[Twelfth Aspect of the Invention]

The portion of being connected to the counter side connector is shielded by a double structure overlapping the counter side shield shell and the hood portion inside and outside and therefore, the shielding effect is high. Further, operability in connecting the connectors is more excellent than that by connecting means by fastening a bolt.

[Thirteenth Aspect of the Invention]

When the lever is moved to the fitting position, by engaging the cam follower to the lock portion, the cam follower is restricted from moving in the returning direction. Thereby, also the lever is restricted from moving in the returning direction and the lever is locked to the fitting position. The lever is restricted from moving by engaging the lock portion provided at the cam groove and the cam follower and therefore, the lock portion may not be formed at a member supporting the lever.

It is not necessary to form means for restricting movement of the lever on the side of the housing and therefore, it can be realized that the shield shell made by diecasting is provided to the housing. Further, a shielding function can be achieved by providing the shield shell and strength of the shield shell can be increased by making the shield shell by diecasting.

[Fourteenth Aspect of the Invention]

When the two connectors are separated while pivoting the lever from the fitting position to the initial position, the side face of the cam groove brought into sliding contact with the cam follower constitutes substantially the linear shape and therefore, the sliding resistance between the cam follower and the side face is not abruptly varied (the operator feels a node feeling), which is excellent in operability of pivoting the lever.

[Fifteenth Aspect of the Invention]

The portion of fitting the first connector and the second connector can firmly be shielded by fitting the shield shells to each other and connecting the shield shells by the bolt. Further, in a state of fitting the connectors to each other, in addition to operation of engaging the lock portion of the lever and the cam follower, the shield shells are fixed by the bolt and therefore, the two connectors are firmly locked in a fitted state.

DETAILED DESCRIPTION OF PREFERRED EMBODIMENTS

Figure 1:
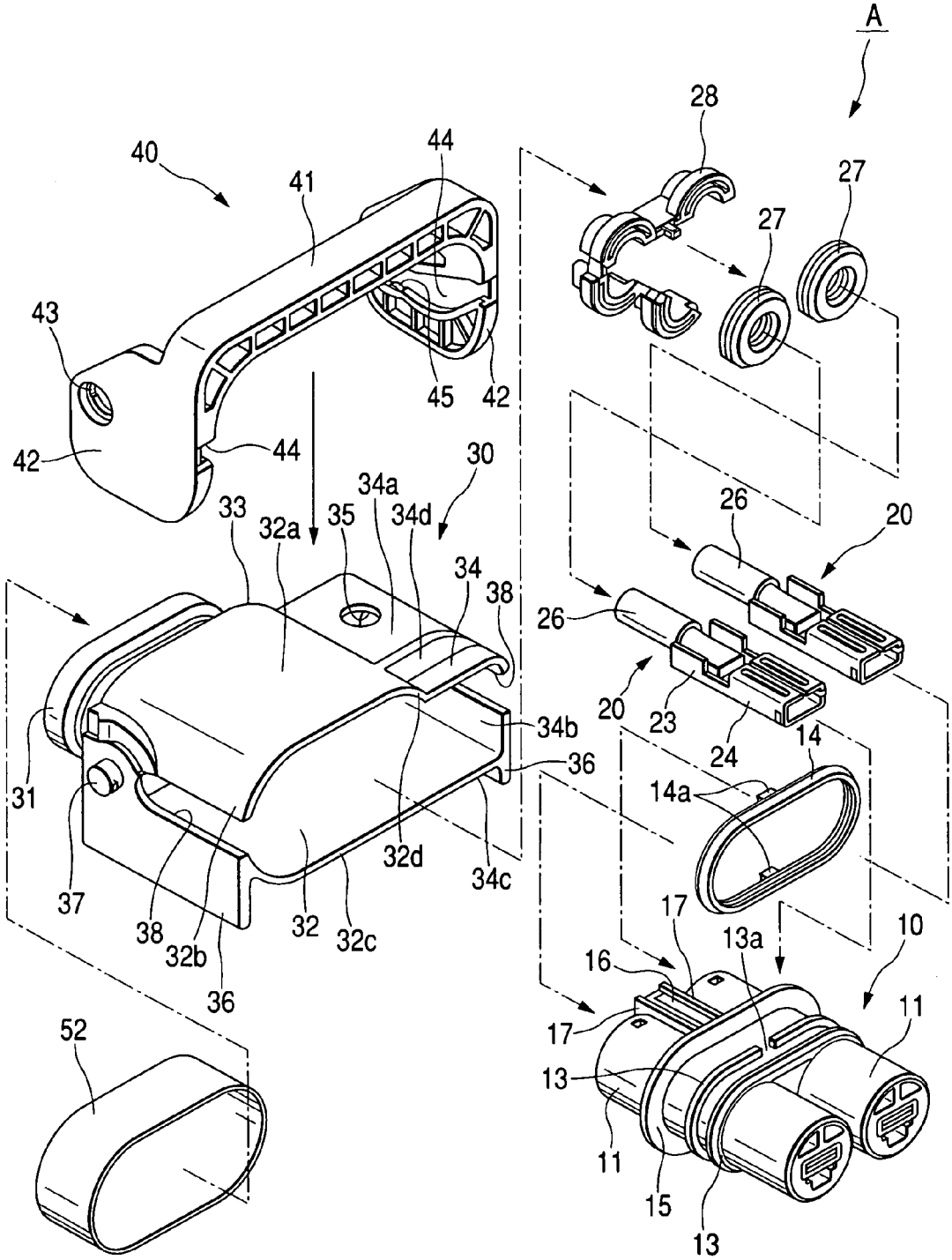
FIG. 1 is a disassembled perspective view of a shield connector (first connector) according to an embodiment.
Figure 2:
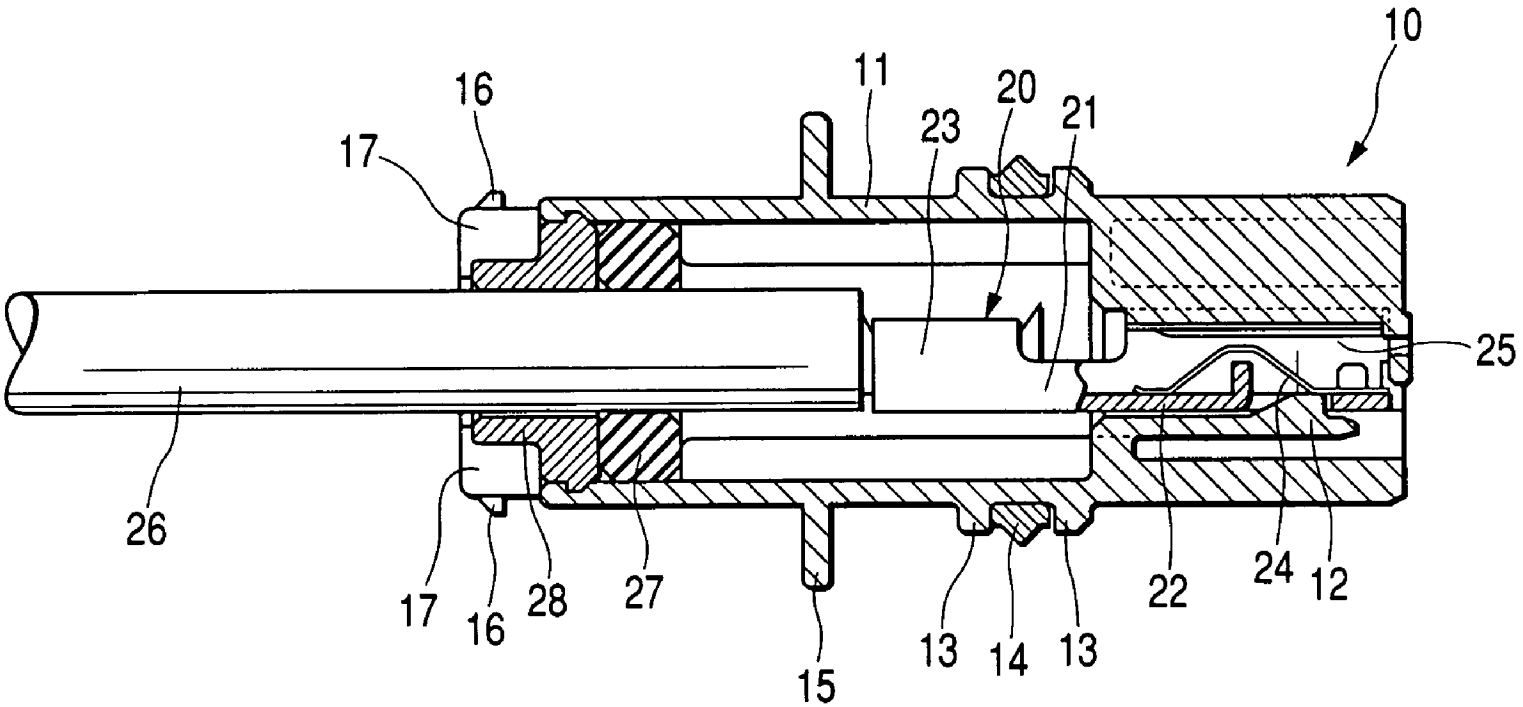
FIG. 2 is a sectional view showing a state of integrating a first terminal metal piece to a first housing.
Figure 3:
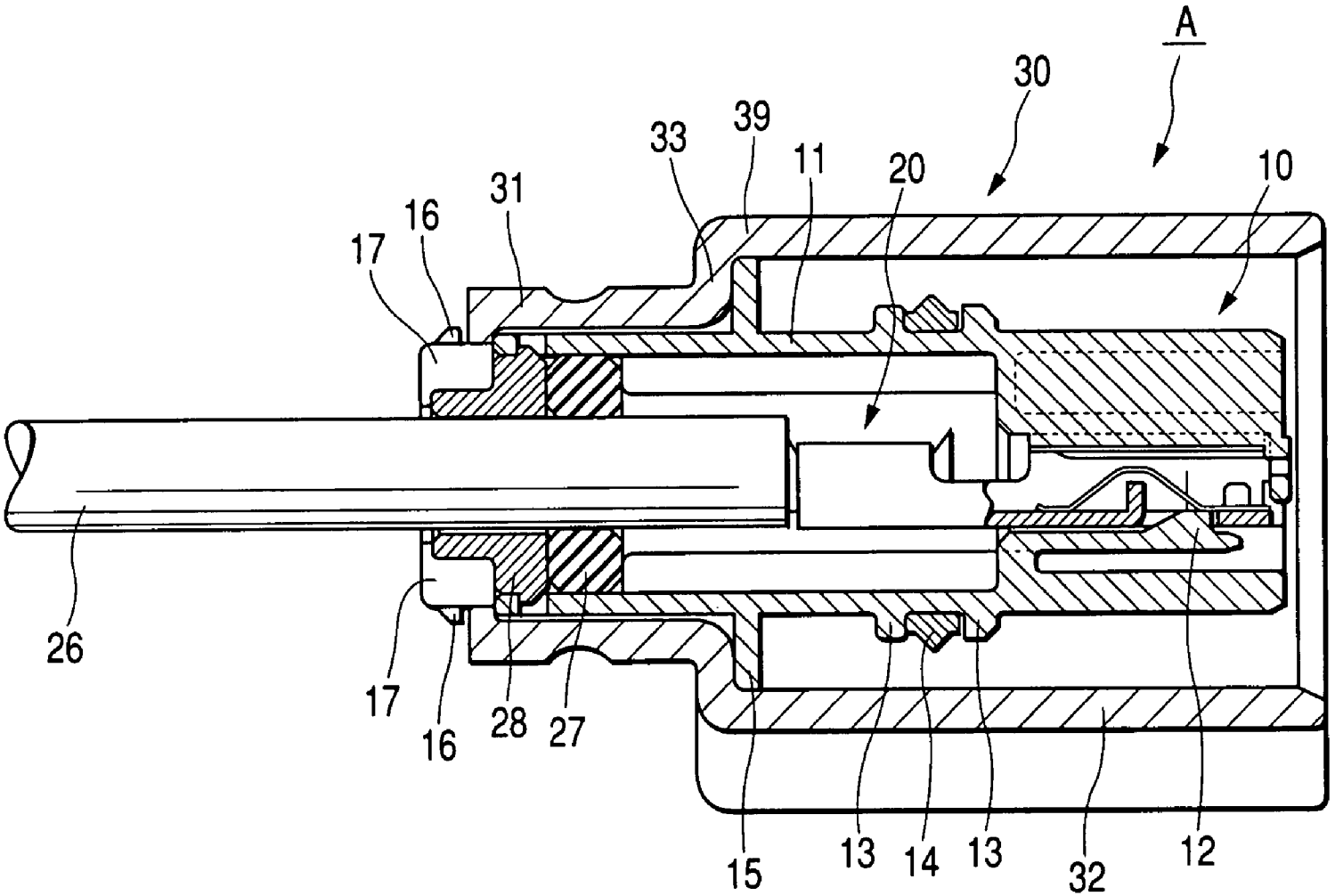
FIG. 3 is a sectional view showing a state of integrating a first shield shell to the first housing from a state of FIG. 2.
Figure 4:
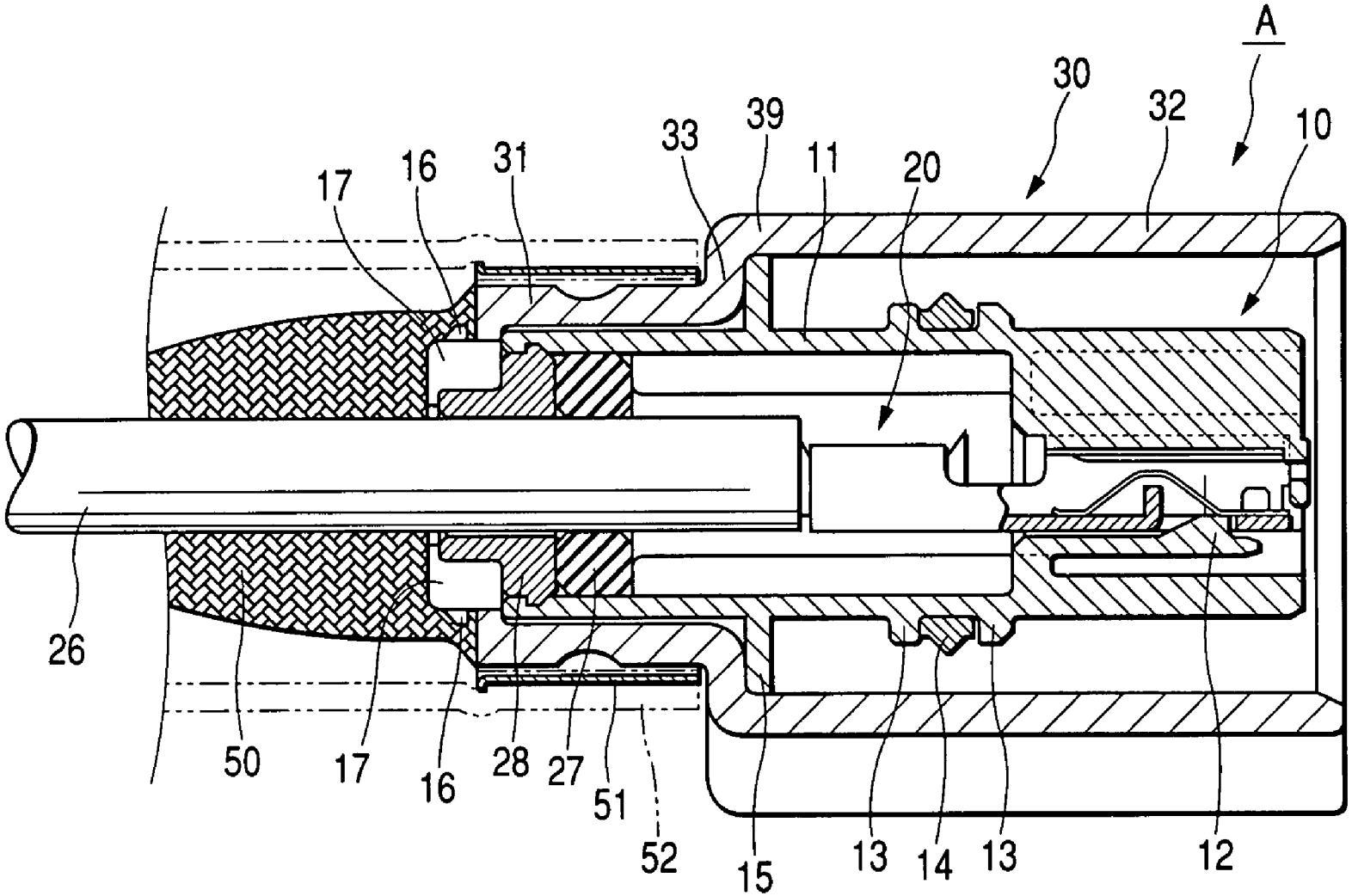
FIG. 4 is a sectional view showing a state of connecting a shield member to the first shield shell from a state of FIG. 3.
Figure 5:
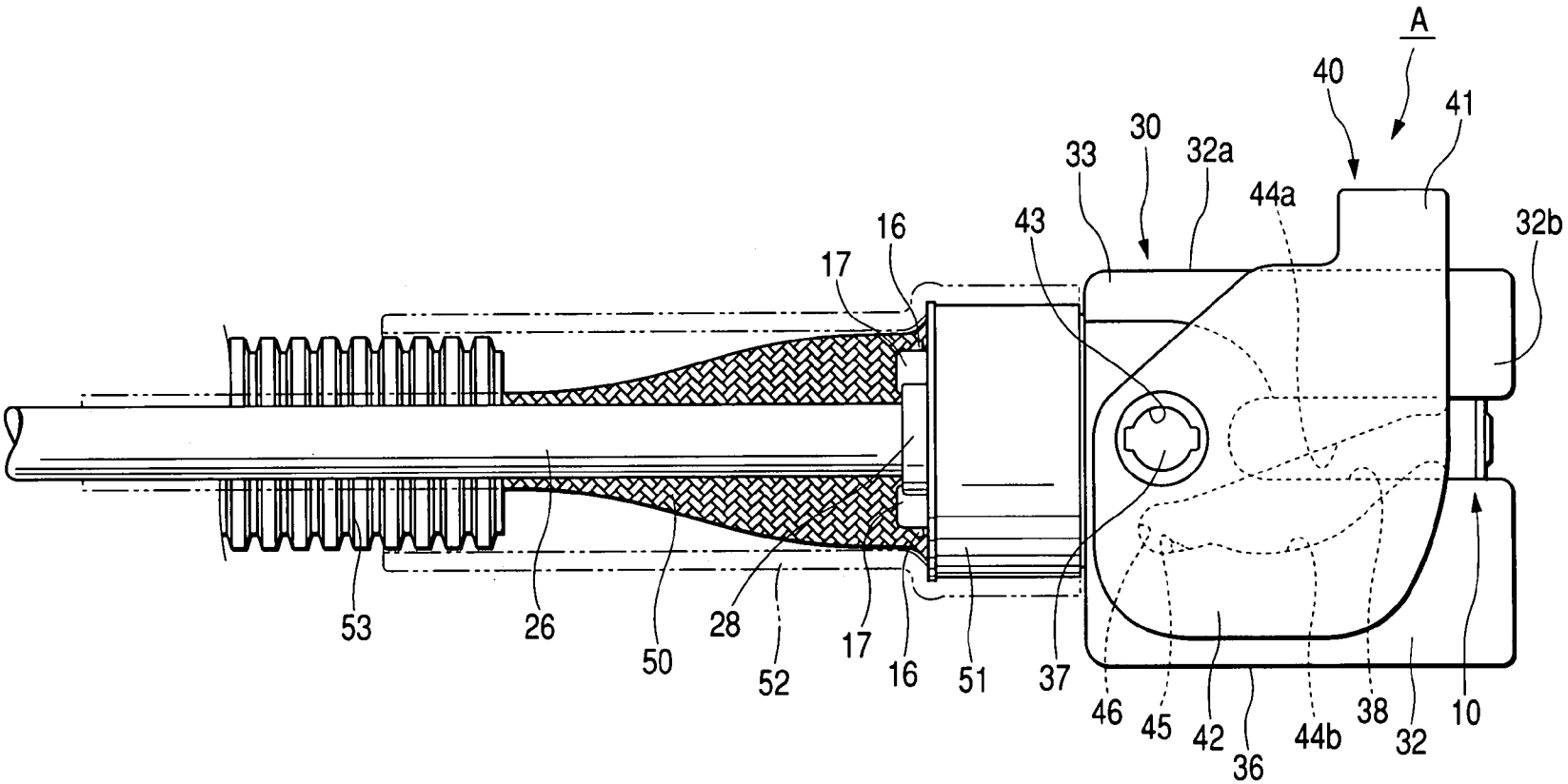
FIG. 5 is a side view of the first connector.
Figure 6:
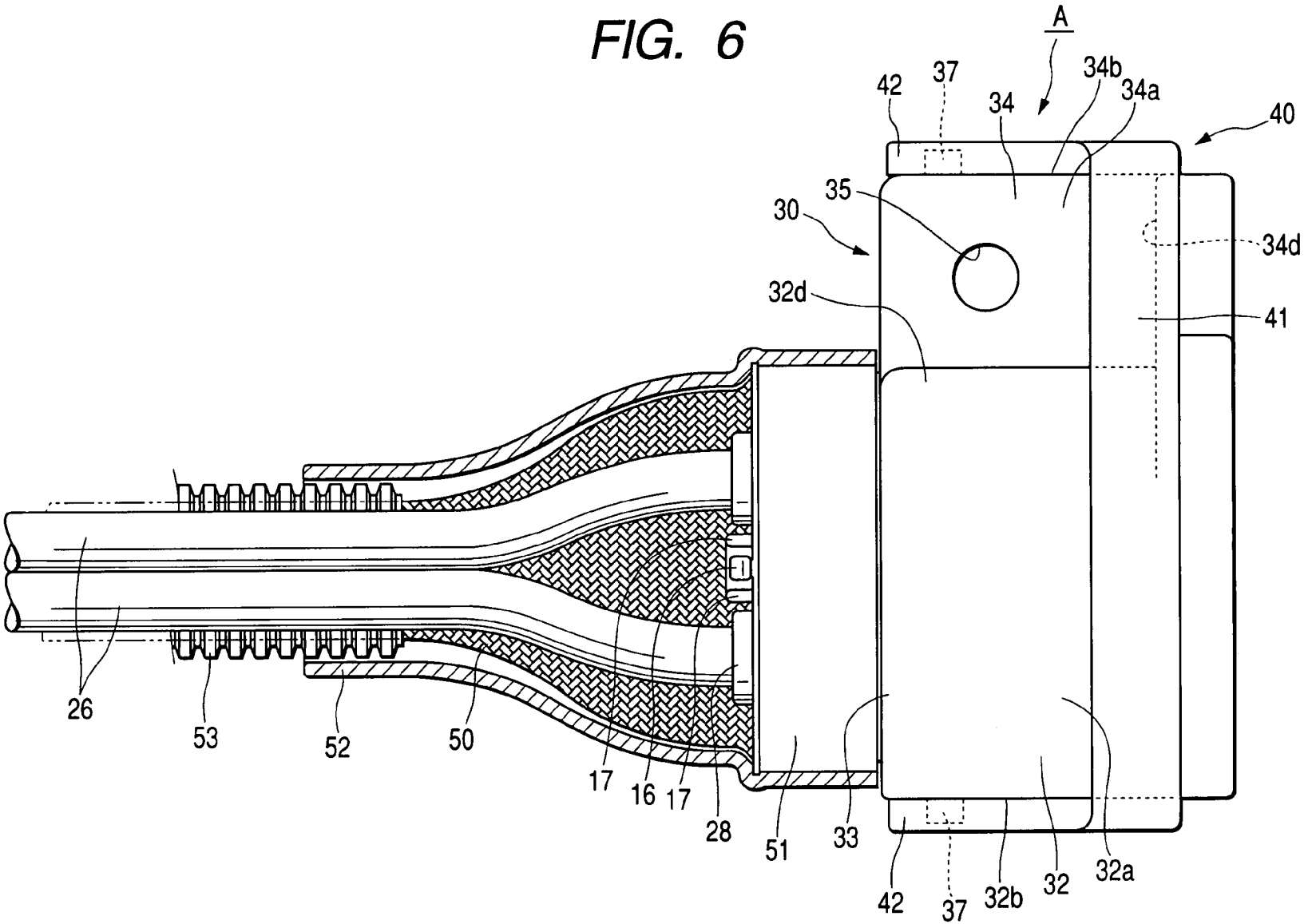
FIG. 6 is a plane view of the first connector.
Figure 7:
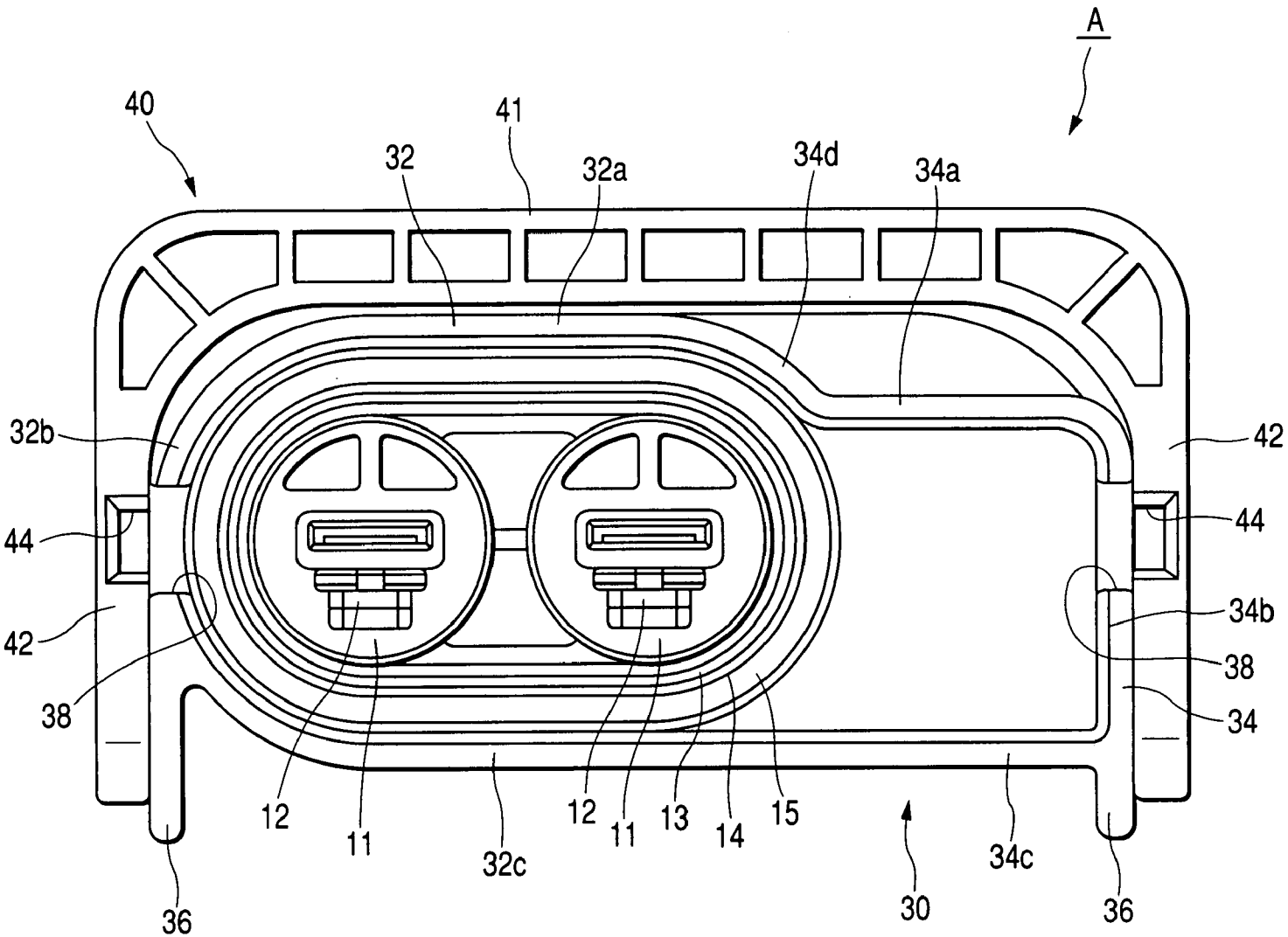
FIG. 7 is a front view of the first connector.
Figure 8:
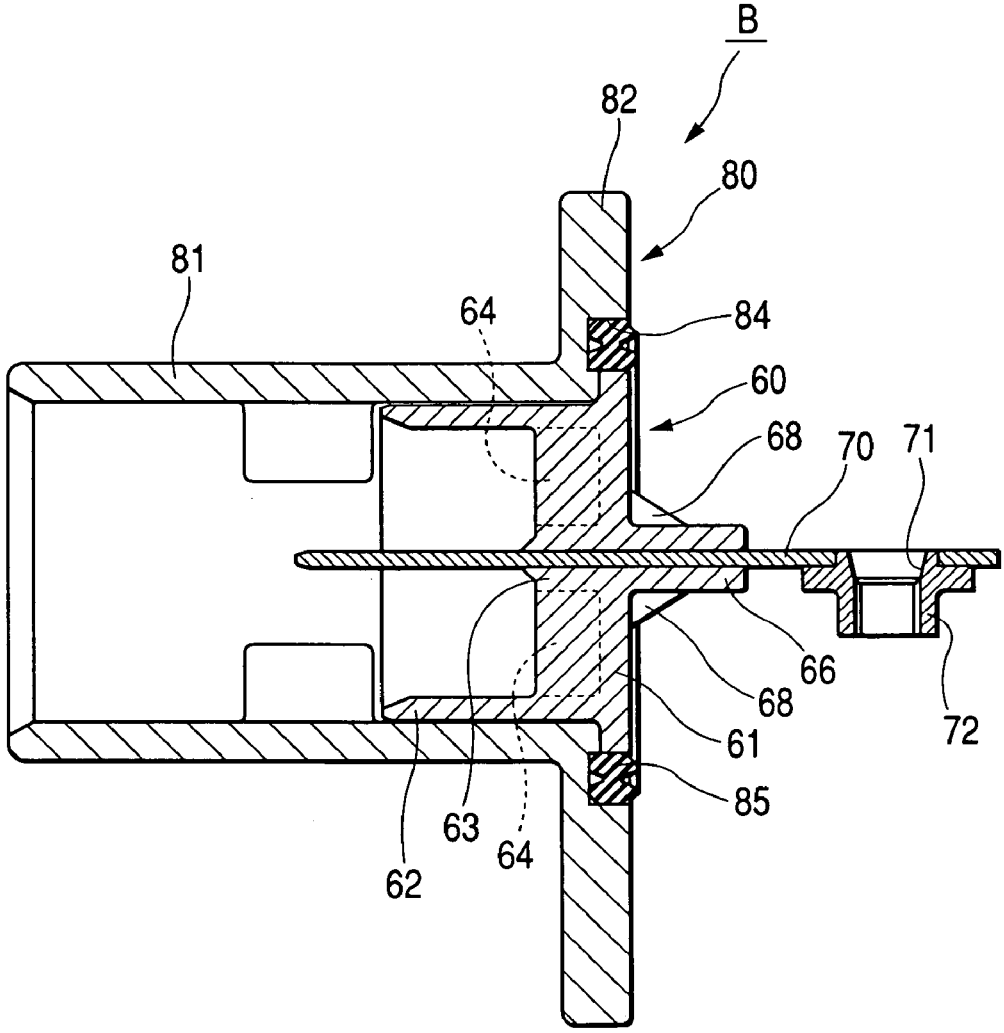
FIG. 8 is a sectional view of a second connector.
Figure 9:
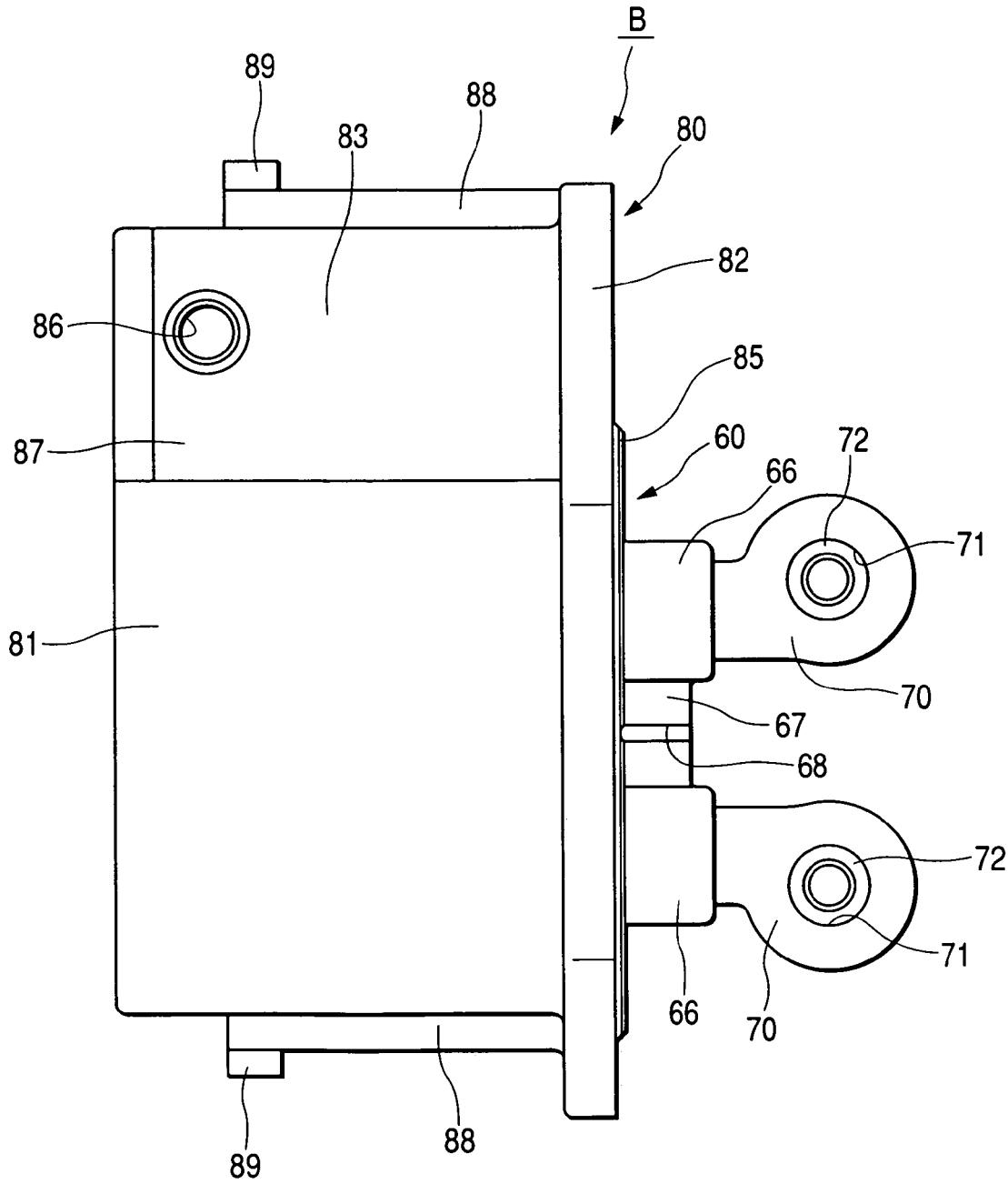
FIG. 9 is a front view of the second connector.
Figure 10:
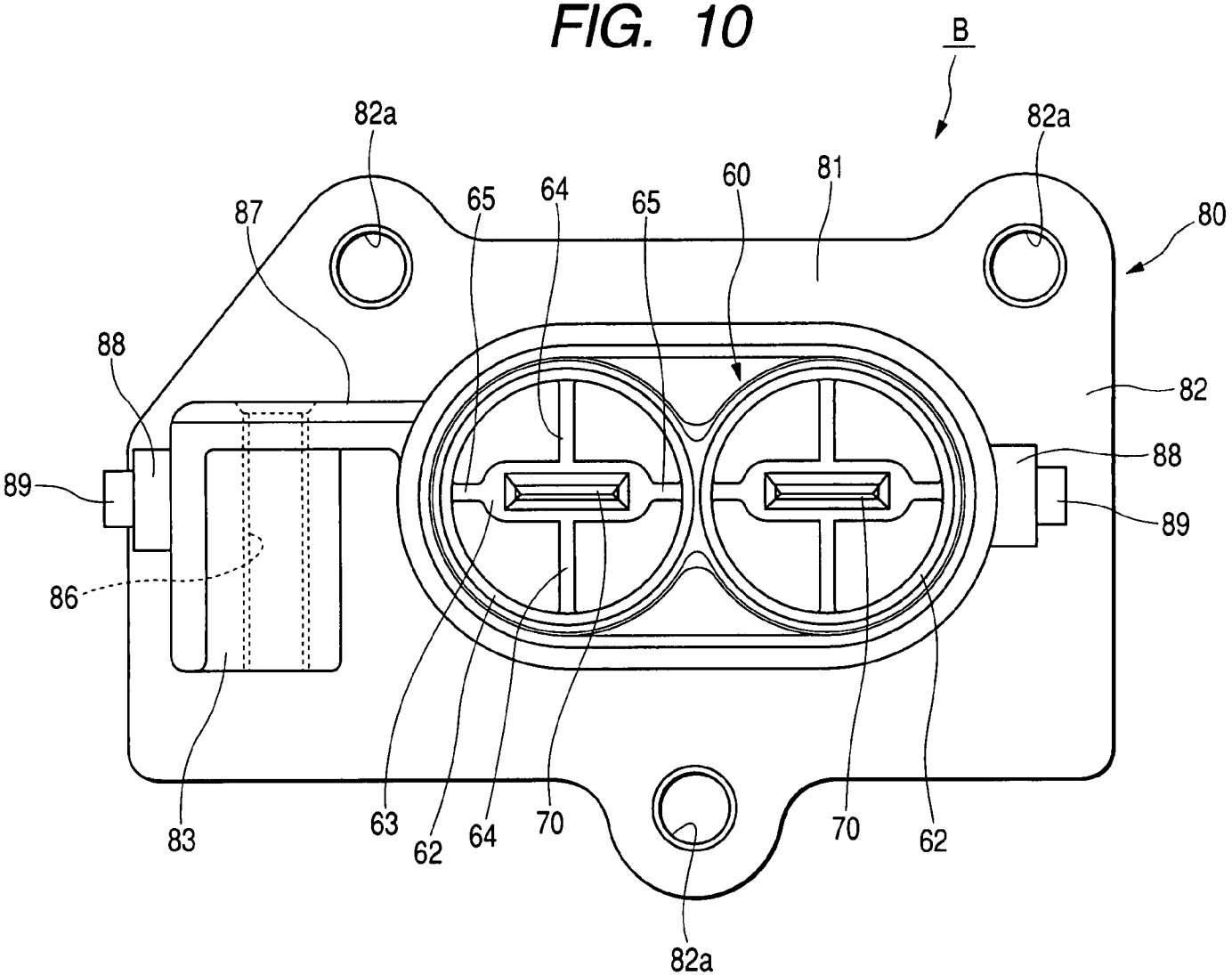
FIG. 10 is a front view of the second connector.
Figure 11:
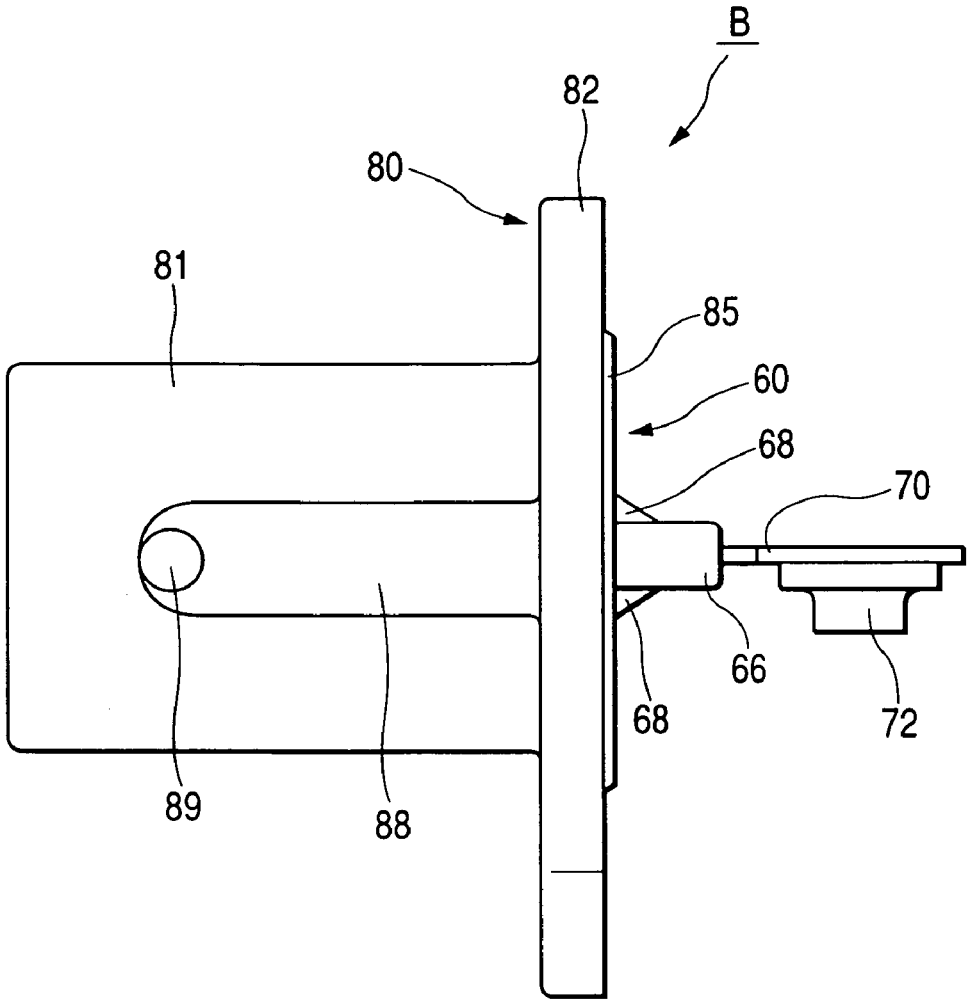
FIG. 11 is a side view of the second connector.
Figure 12:
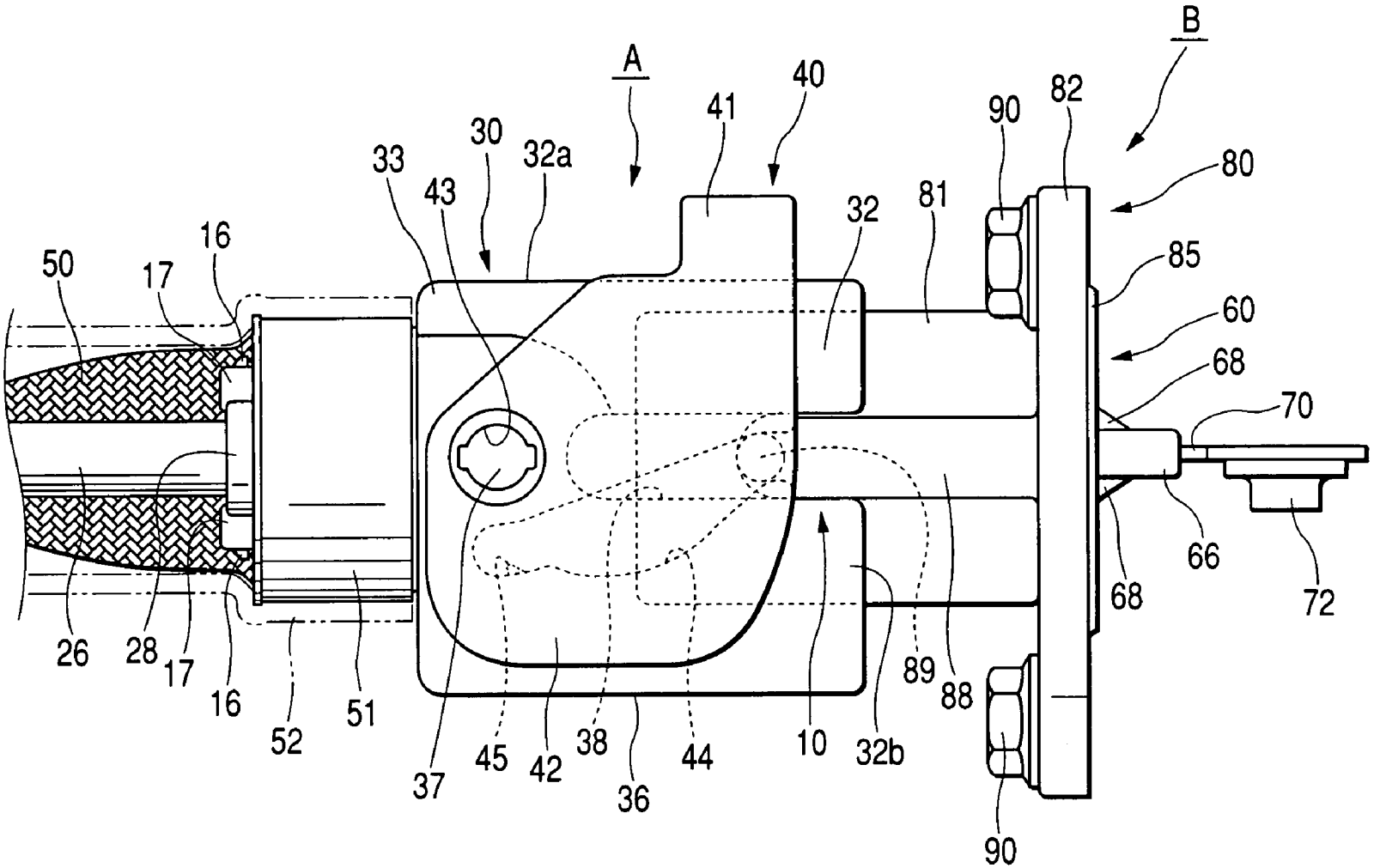
FIG. 12 is a state of shallowly fitting the two connectors.
Figure 13:
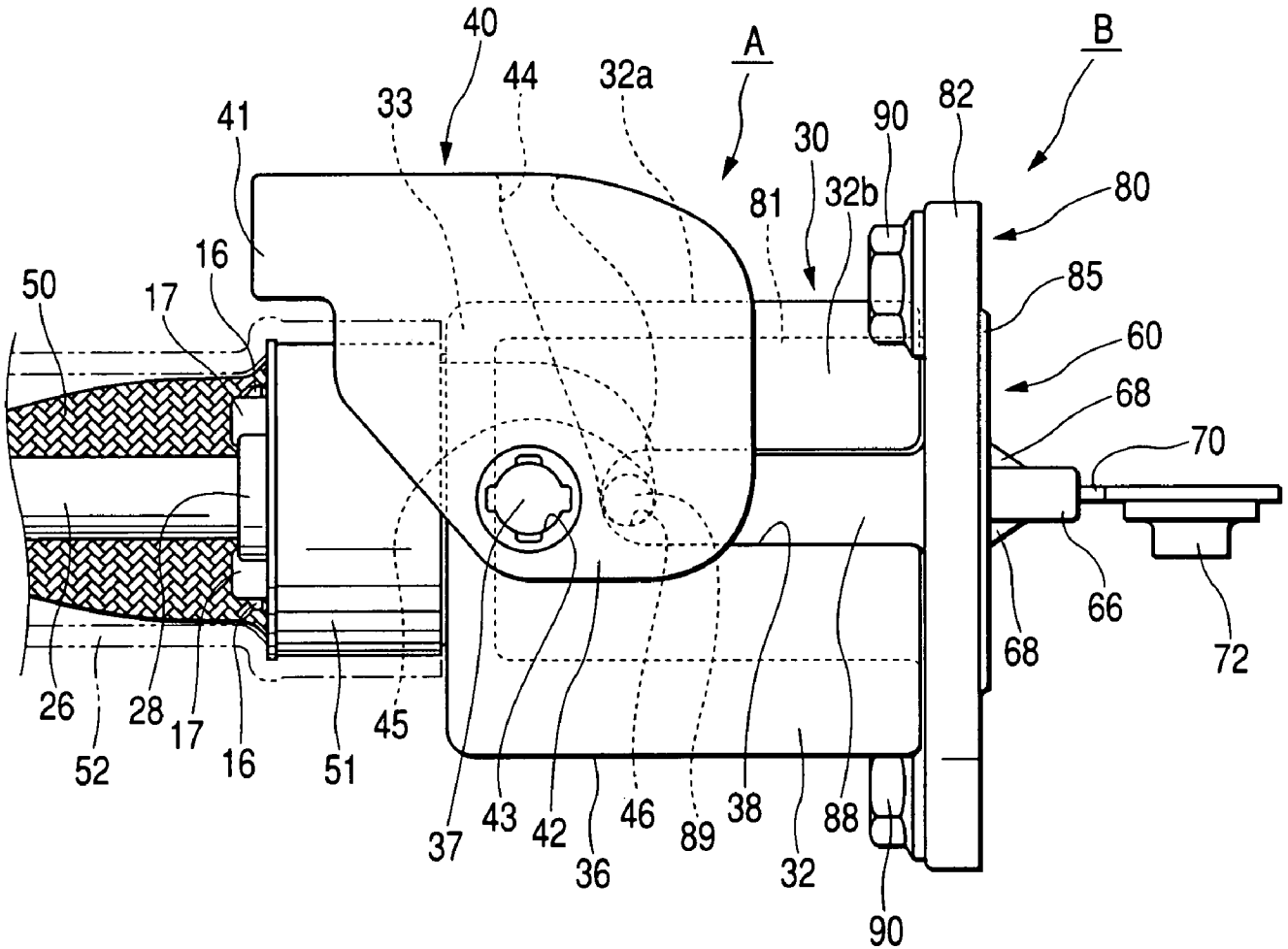
FIG. 13 is a side view showing a state of regularly fitting two housings.

An explanation will be given of an embodiment of the invention with reference to FIG. 1 through FIG. 17 as follows.

According to this embodiment, an explanation will be given of a shield connector (hereinafter, referred to as first connector A) and a structure of fitting and detaching the shield connector and a counter side connector (hereinafter, referred to as second connector B). A lever type connector according to this embodiment is constituted by a first connector A and a second connector B which can be fitted to each other and separated from each other.

The first connector A is constituted by mainly including a first housing 10, a pair of left and right first terminal metal pieces 20, and a first shield shell 30. The first housing 10 is made of a synthetic resin and a pair of left and right terminal containing portions 11 substantially constituting a cylindrical shape and penetrated in a front and rear direction are connected to constitute an integral part, and although front end side portions of the terminal containing portions 11 are separated in two in a left and right direction, central portions and rear end portions thereof are made to be continuous. A lance 12 extended in a front direction (right direction of FIG. 2 through FIG. 6) in a cantilever shape is integrally formed at a position of a front end portion at inside of the terminal containing portion 11.

A pair of front and rear holding ribs 13 are formed substantially at a central portion of an outer periphery of the first housing, that is, a front end portion of a region at which the two terminal containing portion 11 are made to be continuous in an oval shape, and a seal ring 14 in an oval shape is mounted between the holding ribs 13. Positioning projections 14*a* are formed to project in a rear direction at a pair of upper and lower linear portions of the seal ring 14, and by fitting the positioning projections 14*a* to notch portions 13*a* formed at the rib 13 on a rear side, the seal ring 14 is positioned in a peripheral direction and restricted from being positionally shifted in the peripheral direction.

A rattling restricting portion 15 constituting a flange-like shape in an oval shape is integrally formed continuously over an entire periphery at a position rearward from the holding rib 13 in the outer periphery of the first housing 10, that is, at a rear end portion of a region at which the two terminal containing portions 11 are continuous in the oval shape. An outer peripheral edge portion of the rattling restricting portion 15 is formed in an arc-like shape to be brought into face contact with an inner periphery of the first shield shell 30.

A rear end portion of the first housing 10 is formed with a pair of upper and lower drawout preventing means disposed at a middle of the two terminal containing portions 11. Each drawout preventing means is provided with a bending lock piece 16 extended in the rear direction in a cantilever shape, and protecting ribs 17 disposed to interpose the bending lock piece 16 from two left and right sides.

The first terminal metal piece 20 comprises two parts of a terminal main body 21 and an elastic contact piece 24 to constitute a so-to-speak female shape. The terminal main body 21 is constituted by bending a metal plate member having a predetermined shape, substantially a front half portion is made to constitute a square cylinder 22 in a square shape and substantially a rear half portion thereof is made to constitute a press contact portion 23 in an open barrel shape. The elastic contact piece 24 is constituted by bending a metal plate member having a predetermined shape thinner than the terminal main body 21 and formed in a ridge shape in a side view thereof as a whole and a front end portion thereof is formed with a pair of left and right attaching walls 25. The elastic contact piece 24 is contained at inside of the square cylinder portion 22 and integrated to the terminal main body 21 by locking the attaching walls 25 by side walls of the square cylinder portion 22.

Each first terminal metal piece 20 is inserted into the terminal containing portion 11 from a rear side and held in a drawout preventing state by being locked by the lance 12. A wire 26 brought into press contact with the press contact portion 23 is led out from the terminal containing portion 11 to the rear side. Further, the wire 26 is outwardly fitted with a rubber plug 27, the rubber plug 27 is brought into close contact with a rear end portion of an inner peripheral face of the terminal containing portion 11, and water is prevented from invading inside of the terminal containing portion 11 from a rear external portion by the rubber plug 27. Further, the rubber plug 27 is outwardly fitted to the wire 26 and prevented from being drawn out by a holder 28 in a cylindrical shape outwardly fitted to the wire 26 and locked at inside of the terminal containing portion 11.

The first shield shell 30 is a diecast product comprising an aluminum alloy and constitutes a cylindrical shape penetrated in the front and rear direction as a whole. Substantially a rear half portion of the first shield shell 30 constitutes a fitting cylinder portion 31 formed by an oval shape elongated in a lateral direction. A hood portion 32 larger than the fitting cylinder portion 31 by one size is projected in a front direction from a front end edge of the fitting cylinder portion 31 and a boundary portion of a front end of the fitting cylinder portion 31 and a rear end of the hood portion 32 is formed with a stepped difference portion 33 bent in a step-like shape continuously over an entire periphery thereof.

The hood portion 32 is constituted by a shape similar to that of the fitting cylinder portion 31, that is, an oval shape elongated in a lateral direction except an end portion on a right side thereof in view from a front face thereof and the right end portion of the hood portion 32 is formed with a bulged portion 34 bulged in an outer side direction in a shape of a square box to communicated with inside of the hood portion 32. Although a lower wall 34*c* of the bulged portion 34 is continuous to be flush with a lower wall 32*c* of the hood portion 32, an upper wall 34*a* of the bulged portion 34 is disposed at a height one stage lower than that of an upper wall 32*a* of the hood portion 32. Further, the upper wall 34*a* of the bulged portion 34 is formed with a bolt hole 35 penetrated in an up and down direction. Further, a reinforcement rib 34*d* extended in a left and right direction along an upper face (outer face) of the upper wall 34*a* is formed at a position frontward from the bolt hole 35 in the upper wall 34*a* of the bulged portion 34. A left side wall portion 32*b* constituting a semicircular shape of the hood portion 32 and a side wall portion 34*b* of the bulged portion 34 are formed with extended walls 36 extended downward from the lower wall 34*c* of the hood portion 32. Supporting shafts 37 axis lines of which are directed in the left and right direction are formed respectively at a rear end portion of an outer face of the left side wall portion 32*b* and a rear end portion of an outer face of the side wall portion 34*b* of the bulged portion 34 of the hood portion 32 similarly constituting a semicircular shape. Further, there are formed escaping grooves 38 in a mode of being notched linearly in a front and rear direction (direction in parallel with a direction of fitting the second connector B) reaching positions frontward from the support shafts 37 from front end edges of the hood portion 32 and the bulged portion 34 respectively at the outer face of the left side wall portion 32*b* of the hood portion 32 constituting the semicircular shape and the outer face of the side wall portion 34*b* of the bulged portion 34.

Since the first shield shell 30 is made by diecasting, in order to smoothly draw a die for diecasting (not illustrated), an inner periphery of the first shield shell 30 constitutes a slight taper face expanded in the front direction. In constituting the taper shape in this way, it is difficult to ensure high dimensional accuracy with regard to a dimension of the inner periphery over an entire region, and only one location in the direction of drawing the die for diecasting (direction of penetrating the first shield shell 30, that is, front and rear direction) can be set with the high dimensional accuracy. According to the first shield shell 30 of the embodiment, a position at which the dimensional accuracy of the inner periphery is the highest (hereinafter, referred to as a highest accuracy position 39) is set at a rear end portion of the hood portion 32, that is, a portion of the stepped difference portion 33 having a large diameter. A dimension of the inner periphery of the highest accuracy position 39 is set by a dimension the same as a dimension of an outer periphery of the rattling restricting portion 15 of the first housing 10.

A lever 40 is supported by the first shield shell 30. The lever 40 is made of a synthetic resin, constituted by a gate-like mode extended with a pair of arm portions 42 in a plate-like shape from two ends of an operating portion 41 slender in the left and right direction, and made to be pivotable between an initial position (refer to FIGS. 5, 6, 7, 12) for bringing the operating portion 41 proximate to or in contact with an upper face of a front end portion of the hood portion 32 and a fitting position (refer to FIGS. 13, 14, 15, 17) at which the operating portion 41 is made to be disposed at a height upward from a rear end portion of the fitting cylinder portion 31 and substantially the same as that of the operating portion 41 at the initial position by fitting bearing holes 43 of the arm portion 42 to the supporting shafts 37. An inner face of the arm portion 42 is formed with a cam groove 44 in a mode of illustrating substantially an arc centering on the supporting shaft 37 and the bearing hole 43 constituting a center of pivoting the lever 40 in a mode of opening an inlet thereof to an outer peripheral edge of the arm portion 42. When the lever 40 is disposed at the initial position, there is brought about a state in which the inlet of the cam groove 44 corresponds to the escaping groove 38 and opened to the front direction.

A cam follower 89 of the second connector B is brought into sliding contact with a side face 44*a* of an inner side (side of the supporting shaft 37) of two side faces constituting the cam groove 44 in pivoting the lever 40 from the fitting position to the initial position, and the side face 44*a* of the inner side is constituted by a mode extended substantially linearly from the inlet of the cam groove 44 to a depth end side portion thereof. Meanwhile, with regard to a side face 44*b* on the outer side (side opposed to the support shaft 37, that is, an outer peripheral edge side of the arm portion 42), a region (region occupying a large portion of the cam groove 44) reaching a position proximate to the depth end portion from the inlet of the cam groove 44 is made to constitute substantially an arc shape substantially centering on a position eccentric from the support shaft 37 and the depth end portion region of the cam groove 44 constitutes a circular arc shape concentric with the supporting shaft 37.

A lock portion 45 projected substantially in a triangular shape to an inner side is formed at a region 44*c* in a circular arc shape of the side face 44*b* on the outer side. An interval between the side face 44*a* on the inner side and the side face 44*b* on the outer side of the cam groove 44 is rapidly and mostly narrowed and the minimum width dimension is constituted by a dimension smaller than an outer diameter of the cam follower 89. Further, at the depth end portion of the cam groove 44, that is, a portion of the cam groove 44 on the depth side of the lock portion 45, the side face 44*a* on the inner side and the side face 44*b* on the outer side of the cam groove 44 are made to be continuous via a receiving face 46 in a semicircular shape. A radius of curvature of a circular arc of the receiving face 46 is constituted by a dimension substantially the same as an outer diameter of the cam follower 89, Meanwhile, the first housing 10 is integrated to inside of the first shield shell 30. In integrating, two pieces of the wires 26 led out from the first housing 10 are penetrated through the first shield shell 30 and the first housing 10 is fitted to inside of the first shield shell 30 from the front side. In a state in which the first housing 10 is fitted to a regular position, an outer peripheral face of the rattling restricting portion 15 is brought into close contact with the highest accuracy position 39 at the inner periphery of the first shield shell 30. By bringing the outer peripheral face of the rattling restricting portion 15 and the inner peripheral face of the hood portion 32 into contact with each other, the first housing 10 is restricted from being idled (rattled) in the up and down direction and the left and right direction, that is, a direction orthogonal to the direction of fitting the two connectors A, B relative to the first shield shell 30.

Further, the right side end portion of the hood portion 32 formed with the highest accuracy position 39 is communicated with a hollow inside of the bulged portion 34 and therefore, at a portion of the rattling restricting portion 15 facing the bulged portion 34, the inner peripheral face of the hood portion 32 is not brought into contact with the rattling restricting portion 15, however, a portion of the upper wall 32*a* of the hood portion 32 is constituted by a circular arc shape and a portion 32d thereof in the circular arc shape is brought into contact with the rattling restricting portion 15 from a skewed right upper side and therefore, the rattling restricting portion 15 is not idled to the right side relative to the hood portion 32.

In a state in which the first housing 10 is fitted to the regular position, a rear face of the rattling restricting portion 15 is brought into contact with the stepped difference portion 33 from the front side. Thereby, rattling to the rear side and inclination of an attitude thereof in the up and down direction and the left and right direction of the first housing 10 are restricted relative to the first shield shell 30. Further, rattling of the first housing 10 to the front side (drawing direction) relative to the first shield shell 30 is restricted by locking the rear end edge of the fitting cylinder portion 31 by the pair of upper and lower bending lock pieces 16 from the rear side.

Further, since the dimensional accuracy of the inner periphery of the first shield shell 30 is comparatively low at other than the highest accuracy position 39 in contact with the rattling restricting portion 15, there is a concern of opening a clearance 12 between the inner periphery of the fitting cylinder portion 31 and an outer periphery of a rear end portion of the first housing 10 contained at inside of the fitting cylinder portion 31, however, at the rear end portion of the first housing 10, the protecting ribs 17 on the both sides of the bending lock piece 16 are brought into contact with or proximate to the rear end portion of the inner periphery of the first cylinder portion 31 and therefore, the rear end portion of the first housing 10 is not rattled significantly in the up and down direction relative to the first shield shell 30.

Two pieces of the wires 26 led out from the first housing 10 and the field shield shell 30 to the rear side are surrounded summarizingly by a shield member 50 in a cylindrical shape comprising knitted strands constituted by knitting metal slender wires in a mesh-like shape. A distal end portion of the shield member 50 is calked by a calking ring 51 constituting a cylindrical shape in an oval shape in a state of being outwardly fitted to the fitting cylinder portion 31 of the first shield shell 30 and connected to be able to conduct the shield member 50 and the first shield shell 30. A front end portion of a rubber boot 52 surrounding a front end portion of the shield member 50 is brought into close contact to fit with an outer periphery of the calking ring 51. Further, a rear end portion of the rubber boot 52 is brought into close contact to fit with an outer periphery of a front end portion of a corrugate tube 53 surrounding the shield member 50 substantially over an entire length thereof.

Next, the second connector B will be explained.

The second connector B is constituted by including a second housing 60, a pair of left and right second terminal metal pieces 70 and a second shield shell 80. The second housing 60 constitutes a shape of integrating a terminal holding wall 61 substantially in a flat plate shape constituting an oval shape prolonged in a lateral direction, and a pair of left and right cylindrical portions 62 projected from the terminal holding wall 61 in a front direction (right direction of FIGS. 8, 9). The second terminal metal piece 70 comprises a bus bar in a horizontal plate shape slender in a front and rear direction to constitute a so-to-speak male shape. The second housing 60 is integrated with two of the second terminal metal pieces 70 by insert molding. That is, the second terminal metal pieces 70 respectively penetrate the cylindrical portion 62 to project to a front side thereof. Further, rear end portions of the second terminal metal pieces 70 are projected to a rear side of the terminal holding wall 61, and the rear end portions constituting a circular shape are formed with attaching holes 71 penetrated in the up and down direction, and the attaching holes 71 are fixed with nuts 72 in a mode of being projected to a lower side and directing axis lines thereof in the up and down direction by welding or the like. Further, a depth end face of the cylindrical portion 62 is formed with a front side surrounding portion 63 surrounding the second terminal metal piece 70, a vertical rib 64 reaching an inner periphery of the cylindrical portion 62 from each of two upper and lower faces of the front side surrounding portion 63, and a horizontal rib 65 reaching the inner periphery of the cylindrical portion 62 from each of two left and right faces of the front side surrounding portion 63 as means for holding the second terminal metal piece 70. Further, also a rear end face of the terminal holding wall 61 is formed with a rear face side surrounding portion 66 for surrounding the second terminal metal piece 70, a connecting rib 67 for connecting the rear side surrounding portions 66 and an extended rib 68 extended in the up and down direction from each of two upper and lower faces of the connecting rib 67 as means for holding the second terminal metal piece 70.

The second housing 60 integrated with the second terminal metal pieces 70 in this way is integrated to the second shield shell 80. The second shield shell 80 is a diecast product comprising an aluminum alloy and includes a cylindrical portion 81 in an oval shape penetrated in the front and rear direction and prolonged in the lateral direction, a flange portion 82 integrally formed at a rear end edge of the cylindrical portion 81 in the oval shape, and a bolt attaching portion 83 integrally formed with a front face of the flange portion 82. Inside of the cylindrical portion 81 in the oval shape is integrated with the second housing 60 from the rear side. In an integrated state, an outer peripheral edge portion of the second housing 60 is fitted to a notched recess portion 84 formed at a rear face of the flange portion 82 and the two cylindrical portions 62 of the second housing 60 are fitted to an inner periphery of the oval shape cylindrical portion 81. Further, inside of the notched recess portion 84 is mounted with a rubber ring 85 in an oval shape along an outer peripheral edge of the second housing 60. Further, a front end portion of the second terminal metal piece 70 projected from the cylindrical portion 62 is contained at inside of the oval shape cylindrical portion 81.

The bolt attaching portion 83 is disposed on the left side of the oval shape cylindrical portion 81 in view from a front face of the second connector B, and constitutes a square block shape as a whole. Inside of the bolt attaching portion 83 is penetrated to form with a female screw hole 86 opened to two upper and lower faces thereof and directing an axis line thereof in the up and down direction, that is, in a direction orthogonal to the direction of fitting the two connectors A, B. Outer peripheries of the bolt attaching portion 83 and the oval shape cylindrical portion 81 are connected by a connecting plate 87 extended from an upper face of the bolt attaching portion 83 to be flush therewith. A front end edge of the connecting plate 87 is flush with a front end edge of the oval shape cylindrical portion 81.

Further, guide ribs 88 extended linearly in parallel with the front and rear direction, that is, the direction of fitting the two connectors A, B are respectively formed at a side face on the right side (side opposed to the bolt attaching portion 83) in view from a front face of the oval shape cylindrical portion 81 and a side face on the left side in view from a front face of the bolt attaching portion 83. Further, front end portions of outer side faces of the respective guide ribs 88 are integrally formed with the cam followers 89 projected in a circular cylinder shape respectively directing axis lines thereof in the left right direction, that is, in parallel with the supporting shafts 37 constituting the center of pivoting the lever 40. Further, bolt holes 82*a* directing axis lines thereof in the front and rear direction are penetrated to form at two left and right locations of an upper end portion of the flange portion 82 and one location substantially at a center of a lower end portion thereof.

Next, operation of the embodiment will be explained.

First, the second connector B is attached to an apparatus, not illustrated (for example, a motor, an inverter or the like of an electric car). In attaching, the second shield shell 80 is conductively fixed to a shield case of the apparatus by bolts 90 (illustration of screw portions thereof are omitted) penetrated through the respective bolt holes 12*a*, rear end portions of the second terminal metal pieces 70 are inserted into attaching holes of the shield case to connect to apparatus side terminals at inside of the apparatus and fixed by bolts (not illustrated) screwed to the nuts 72. Further, a clearance between an outer wall face of the shield case and the second shield shell 80 is waterproofed by the rubber ring 85.

The first connector A is fitted to the second connector B. In fitting, in a state of holding the lever 70 at the initial position, the hood portion 32 of the first shield shell 30 is outwardly fitted shallowly to the oval shape cylindrical portion 81 of the second shield shell 80 (refer to FIG. 12). When the first connector A is fitted to the second connector B, the shield shells 30, 80 and the housings 10, 60 of the two connectors A, B can be connected in one action. When the two connectors A, B are shallowly fitted, front end portions of the guide ribs 88 are fitted to the escaping grooves 38 of the hood portion 32 and the cam followers 89 are moved into the inlets of the cam grooves 44. At this occasion, the first housing 10 and the second housing 60 are not fitted yet, further, the first terminal metal piece 20 and the second terminal metal piece 70 are not brought into contact with each other.

When the lever 40 is pivoted from the state in the fitting direction (counterclockwise direction of FIG. 12) proximately by 90°, by cam operation by engagement (sliding contact) of the cam follower 89 and the side face 44*b* on the outer side constituting the arc-like shape of the cam groove 44, the first connectors A is attracted to a side of the second connector B, in the procedure, the front end portion of the terminal containing portion 11 of the first housing 10 is fitted into the cylindrical portion 62 of the second housing 60, and the elastic contact piece 24 of the first terminal metal piece 20 is brought into elastic contact with the front end portion of the second terminal metal piece 70. Further, by bringing the seal ring 14 at the outer periphery of the first housing 10 and the inner periphery of the oval shape cylindrical portion 81 of the second shield shell 80 into close contact with each other, fitting peripheral faces of the two connectors A, B are waterproofed.

Figure 16:
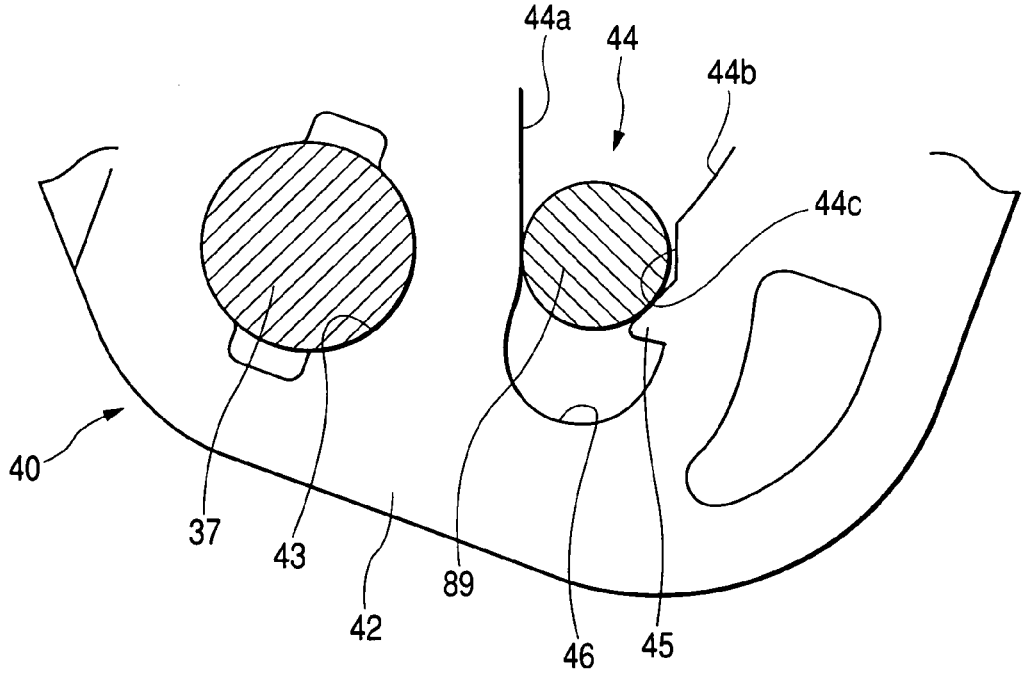
FIG. 16 is a partially enlarged sectional view showing a positional relationship between a cam groove of a lever and a cam follower in a state immediately before the two connectors are fitted regularly.
Figure 17:
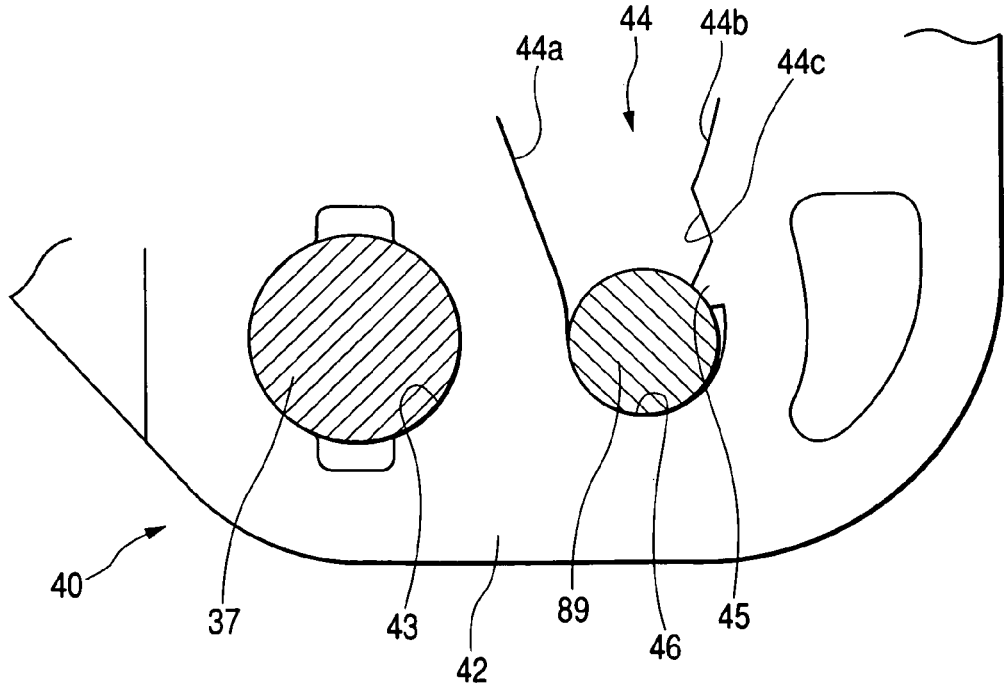
FIG. 17 is a partially enlarged sectional view showing a positional relationship between the cam groove of the lever and the cam follower in the state of regularly fitting the two connectors.

Further, when the lever 40 is pivoted to immediately before the lever 40 reaches the fitting position, as shown by FIG. 16, the lock portion 45 of the cam groove 44 is made to butt the cam follower 89 and therefore, operation of pivoting the lever 40 temporarily becomes heavy. When a pivoting operating force exerted to the lever 40 is intensified here, the lock portion 45 is slightly crushed to deform by the cam follower 89 and the lock portion 45 passes the cam follower 89 while elastically deforming the arm portion 42 to widen a groove width of the cam groove 44. When the lock portion 45 passes the cam follower 89, the arm portion 42 is elastically recovered, the receiving face 46 constituting the semicircular arc shape at the depth end of the cam groove 44 is fitted (brought into contact with) the cam follower 89 and the lever 40 reaches the predetermined fitting position (refer to FIG. 17). Under the state, the receiving face 46 of the cam groove 44 and the lock portion 45 sandwich the cam follower 89 in a peripheral direction and therefore, the lever 40 is restricted from being pivoted in a direction of returning to the initial position relative to the cam follower 89. That is, thereby, the lever 40 is locked at the fitting position and the two connectors A, B are locked in a regularly fitted state.

When the lever 40 reaches the fitting position and the two connectors A, B reach the regularly fitted state in this way, while maintaining the state of bringing the terminal metal pieces 20, 70 into contact with each other, the hood portion 32 of the first shield shell 30 and the oval shape cylindrical portion 81 of the second shield shell 80 are deeply fitted to constitute a double cylinder structure of being overlapped inside and outside by a predetermined dimension in the front and rear direction. Further, the front end of the second shield shell 80 is brought into contact or proximate to be opposed to the rattling respecting portion 15 of the second housing 60 from the front side.

Figure 14:
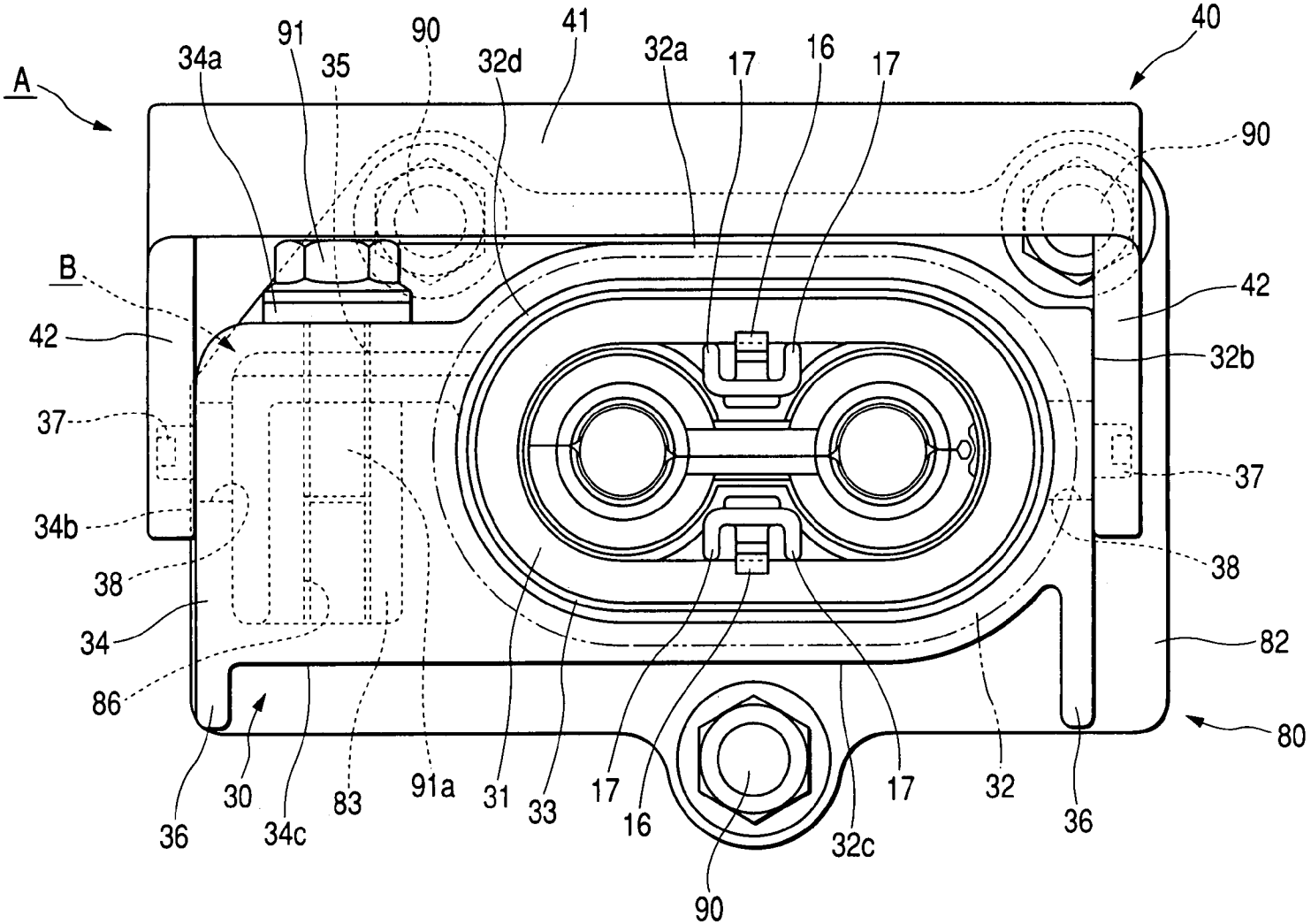
FIG. 14 is a rear view showing a state of regularly fitting the two connectors.
Figure 15:
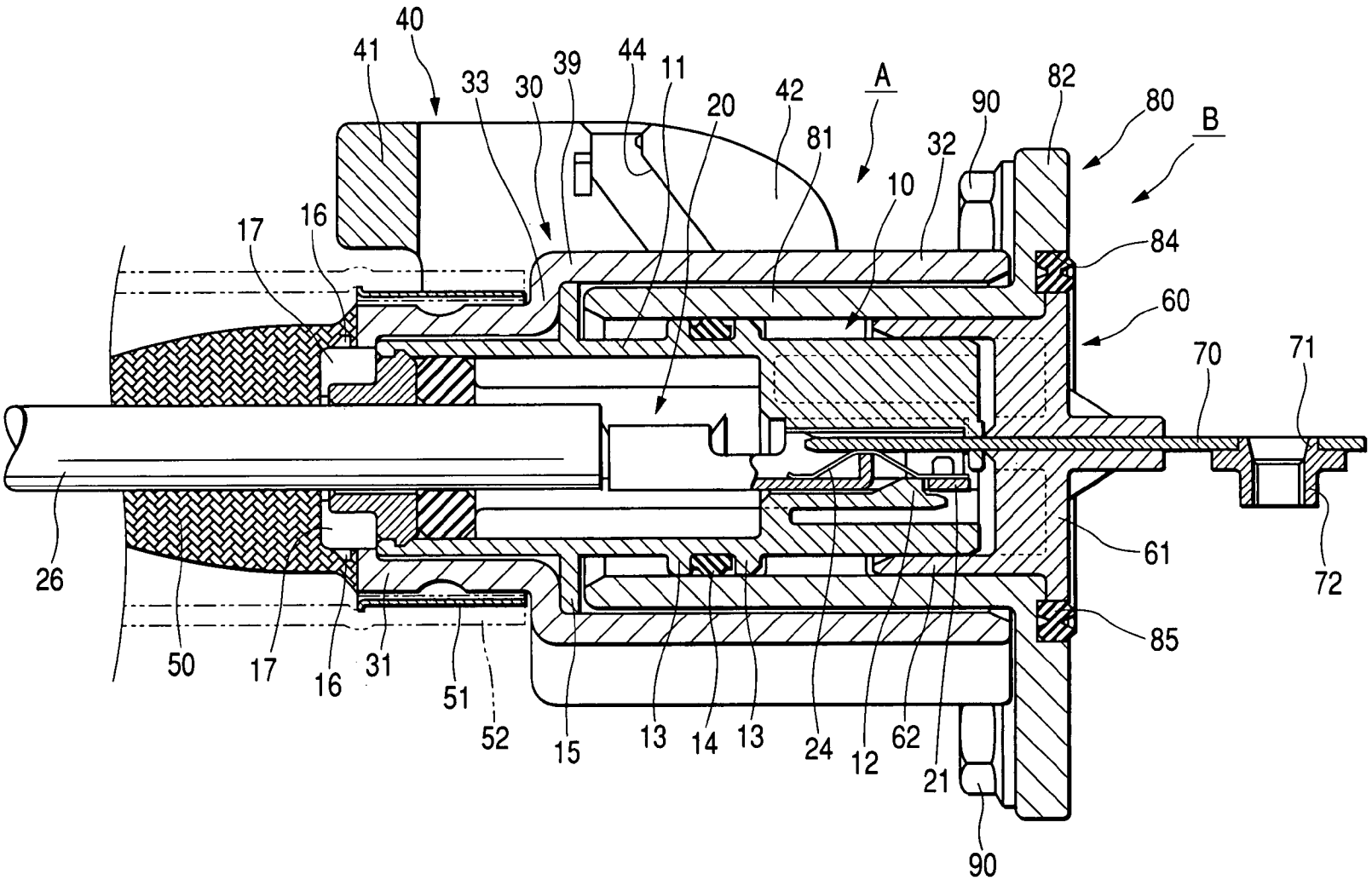
FIG. 15 is a sectional view showing the state of regularly fitting the two connectors.

When the lever 40 is finished to pivot, a male screw portion 91*a* of the bolt 91 is inserted into the bolt hole 35 of the first shield shell 30 from above to screw to fasten the female screw hole 86 of the second shield shell 80 (refer to FIG. 14). Thereby, the first shield shell 30 and the second shield shell 80 are fixed conductively and in a state of being restricted to idle in any direction of the front and rear direction, the left and right direction and the up and down direction and therefore, the two connectors A, B are integrated and the second connector B is attached to the apparatus.

Further, in detaching the first connector A from the second connector B, the lever 40 is pivoted in a direction reverse to that in fitting the connectors. At an initial stage of pivoting, there is produced a resistance by locking the lock portion 45 and the cam follower 89 and therefore, a large pivoting force overcoming the resistance is exerted to the lever 40. Then, the lever 40 is swiftly pivoted to the initial position by inertia immediately after the lock portion 45 passes the cam follower 89. In accordance with pivoting the lever 40, the first connector A is pushed back by engaging the cam follower 89 and the cam groove 44 to detach from the second connector B. At this occasion, the side face 44*a* on the inner side brought into sliding contact with the cam follower 89 is constituted substantially by a linear shape and therefore, the sliding resistance between the cam follower 89 and the side face 44*a* is not varied abruptly.

Effects of the embodiment are as follows.

(1) The cam groove 44 is formed with the lock portion 45 for restricting the cam follower 89 from being displaced in the returning direction relative to the cam groove 44 by engaging the cam follower 89 to the cam groove 44 in the state of moving the lever 40 to the fitting position. Thereby, the lever 40 is restricted from being moved in the direction of returning to the initial position and the lever 40 is locked to the fitting position. In this way, as means for restricting the lever 40 moved to the fitting position from being moved, the lock portion 45 provided at the cam groove 44 and the cam follower 89 are engaged and therefore, locking means needs not to form at the first shield shell 30 supporting the lever 40 and therefore, a shape of an outer face of the first shield shell 30 is simplified.

(2) Particularly, according to the embodiment, the first shield shell 30 (shielding means) supporting the lever 40 is made by diecasting and therefore, it is effective to simplify the shape of the outer periphery of the first shield shell 30 for simplifying a die structure and therefore, enabling to reduce cost of the die.

(3) The first shell 30 made by diecasting is also provided with a function of protecting the first housing 10 since rigidity and strength thereof are higher than those of a constitution formed by pressing a metal plate member having a comparatively thin wall thickness.

(4) In the state of fitting the two connectors A, B, the first shield shell 30 overlaps to surround the second shield shell 80, the fitted two shield shells 30, 80 are conductively fixed by the bolt 91 in the direction substantially orthogonal to the fitting direction and therefore, the fitted portions of the first connector A and the second connector B can firmly be shielded.

(5) In the state of fitting the two connectors A, B, in addition to operation of engaging the lock portion 45 of the lever 40 and the cam follower 89, the shield shells 30, 80 are fixed by the bolt 91 and therefore, the two connectors A, B can be locked in the fitted state.

(6) A drawback caused by a situation that the first shield shell 30 is made by diecasting can be resolved. That is, in order to smoothly draw the die for diecasting, although it is necessary to form the inner periphery of the first shield shell 30 in the taper face, it is unavoidable that in forming the taper face, the dimension of the inner periphery of the first shield shell 30 is varied and therefore, the first housing 10 is rattled relative to the first shield shell 30. Hence, according to the embodiment, the rattling restricting portion 15 in contact with the highest accuracy position 39 is provided at the first housing 10. Thereby, the first housing 10 can be restrained from being rattled relative to the first shield shell 30 in the direction intersecting with the direction of drawing the die.

(7) According to the first connector A, the shield member 50 is connected to the outer periphery of the first shield shell 30 by calking and therefore, operability thereof is more excellent than that in a connecting method of using a bolt, welding or the like.

(8) The shielding member 50 is connected to the first shield shell 30 by calking and the position of the first shield shell 30 brought into contact with the rattling restricting portion 15 (highest accuracy position 39) is set to the position deviated to the front side of the fitting cylinder portion 31 constituting the region of calking the seal member 50 (that is, region rearward from the stepped difference portion 33 of the first shield shell 30). Therefore, even when the fitting cylinder portion 31 is deformed to contract a diameter thereof by calking, the function of restraining rattling is not hampered by being brought into contact with the rattling restricting portion 15.

(9) The rattling restricting portion 15 is brought into contact with the stepped difference portion 33 formed at the first shield shell 30 to change the inner diameter dimension in the stepped difference shape in the direction substantially in parallel with the direction of drawing the die and therefore, the first housing 10 is prevented from being idled (rattled) in the direction of drawing the die relative to the first shield shell 30.

(10) In separating the two connectors A, B while pivoting the lever 44, the side face 44*a* of the cam groove 44 brought into sliding contact with the cam follower 89 constitutes substantially the linear shape and therefore, the sliding resistance between the cam follower 89 and the side face 44*a* is not varied rapidly (the operator feels a node feeling), which is excellent in operability of pivoting the lever 44.

OTHER EMBODIMENTS

The invention is not limited to the embodiment explained by the above-described description and the drawings but, for example, also the following embodiments are included in the technical range of the invention, further, the invention can be embodied by being variously modified within the range not deviated from the gist other than described below.

(1) Although according to the above-described embodiment, the hood portion of the shield shell of the first connector (shield connector) is fitted along the outer periphery of the fitting portion of the shield shell of the second connector (counter side connector), according to the invention, the hood portion of the shield shell of the first connector may be fitted along the inner periphery of the fitting portion of the shield shell of the second connector.

(2) According to the above-described embodiment, one of the shield shells may be outwardly fitted to other of the shield shells by constituting a mode in which either one of the shield shell of the first connector and the shield shell of the second connector is constituted by a cylindrical shape and other thereof is brought into close contact with the outer periphery of the housing.

(3) Although according to the above-described embodiment, both of the shield shells of the two connectors are made by diecasting, according to the invention, either one of the shield shells of the two connectors or both of the shield shells may be formed by a fabricating method other than diecasting (for example, a method of pressing a thin plate, or a method of cutting a metal block).

(4) Although according to the above-described embodiment, an explanation has been given of the case in which the second connector is an intermediate connector capable of being dealt with by itself, the invention is applicable also to a case in which the second connector is integrally formed with an apparatus (for example, a motor, an inverter or the like of an electric car).

(5) Although according to the above-described embodiment, the shield member is connected to the shield shell by calking, according to the invention, the method of connecting the shield member to the shield shell may be a method other than calking such as fastening a bolt, welding or the like.

(6) Although according to the above-described embodiment, the shield shells of the two connectors are fixed by the bolt, according to the invention, there may be constituted a structure in which the shield shells are not fixed by the bolt but the shield shells are brought into contact with each other or extremely proximate to each other to overlap.

(7) Although according to the above-described embodiment, the lever is used as the means for fitting the two connectors, the invention is applicable also to a case in which the two connectors are fitted without using the lever.

(8) Although according to the embodiment, the rattling restricting portion is formed integrally with the housing, according to the invention, the rattling restricting member may be provided as a part separate from the housing and the rattling restricting member may be integrated into housing. In this case, it is preferable to form both of the housing and the rattling restricting member by a method of being able to achieve high dimensional accuracy.

(9) Although according to the above-described embodiment, the contact position of the rattling restricting portion (position having the highest dimensional accuracy in the inner periphery of the shield shell) is set to the position substantially at the center in the direction of drawing the die, according to the invention, the contact position may be provided at a position of an end portion of the shield shell or proximate to the end portion.

(10) Although according to the embodiment, the rattling restricting portion is constituted by a mode of being continuous over the entire periphery of the housing, according to the invention, a plurality of rattling restricting portions may be provided by opening intervals in the peripheral direction.

(11) Although according to the embodiment, the shield shell is formed with the stepped difference portion and the rattling restricting portion is brought into contact with the stepped difference portion, according to the invention, the rattling restricting portion may be brought into contact with a position remote from the stepped difference position.

(12) Although according to the above-described embodiment, the stepped difference portion is provided at the shield shell, the invention is applicable also to a case in which the stepped difference portion is not formed at the shield shell.

(13) Although according to the above-described embodiment, an explanation has been given of the case in which a portion of the shield shell constitutes the hood portion surrounding the housing by opening a clearance between the portion and the outer periphery of the housing of the hood portion, the invention is applicable also to a case in which the shield shell is not provided with such a hood portion.

(14) Although according to the above-described embodiment, the shield member is connected to the shield shell by calking, according to the invention, the method of connecting the shield member to the shield shell may be constituted by a method other than calking of screwing a bolt, welding or the like.

(15) Although according to the above-described embodiment, an explanation has been given of the case in which the counter side connector is an intermediate connector capable of being dealt with by itself, the invention is applicable to a case in which the counter side connector is a connector integrally formed with an apparatus (for example, a motor, an inverter of an electric car).

(16) Although according to the above-described embodiment, the shield shell is connected to the counter side connector by the bolt, according to the invention, there may be constituted a structure in which the shield shell is not connected to the counter side connector by the bolt.

(17) Although according to the above-described embodiment, the lever is used as means for fitting the counter side connector, the invention is also applicable to a case of being fitted without using the lever.

(18) Although according to the above-described embodiment, the position of bringing the rattling restricting portion into contact with the first shield shell is disposed at the position of the highest dimensional accuracy of the inner periphery of the first shield shell, according to the invention, the rattling restricting portion may be brought into contact therewith at a position having dimensional accuracy lower than that of the highest accuracy position without being limited to the position having the highest dimensional accuracy.

(19) Although according to the above-described embodiment, an explanation has been given of the case in which the lever is pivotably supported, the invention is applicable to a lever type connector of a type of sliding a lever.

(20) Although according to the above-described embodiment, an explanation has been given of the case in which the side of the outer face of the first connector is constituted by the shield shell made by diecasting, the invention is applicable also to a case in which the outer face of the first connector is constituted by a part which is formed without using diecasting. In this case, means for constituting the outer face of the first connector may be separate from the housing or integral with the housing. Further, when the side of the outer face is constituted by a part separate from the housing, the part is not limited to a metal product but may be a synthetic resin product.

(21) Although according to the above-described embodiment, an explanation has been given of the case in which the side of the outer face of the second connector is constituted by the shield shell made by diecasting, the invention is applicable also to a case in which the outer face of the second connector is constituted by a part which is formed without using the diecasting. In this case, means for constituting the outer face of the second connector may be separate from the housing or may be integral with the housing. Further, when the side of the outer face is constituted by a part separate from the housing, the part is not limited to a metal product but may be a synthetic resin product.

(22) Although according to the above-described embodiment, an explanation has been given of the case in which the sides of the outer faces of the first connector and the second connector are surrounded by the shield shells, the invention is applicable also to a case in which the two connectors are not provided with a shielding function.

(23) Although according to the above-described embodiment, an explanation has been given of the case in which a mother member for forming the cam follower in the second connector is a metal part made by diecasting, the invention is applicable also to a case in which the mother body of forming the cam follower is a part which is formed without using diecasting (not limited to a metal product but may be a synthetic resin product) and to a case in which the cam follower is formed directly to the housing.

(24) Although according to the above-described embodiment, the lever is made by a synthetic resin and the mother member of forming the cam follower is made by a metal, according to the invention, as a combination of mother members of forming the lever and the cam follower, both of the mother members forming the lever and the cam follower may be made of a synthetic resin, or the lever is made of a metal and the mother body of forming the cam follower may be made of a synthetic resin, or both of the mother members of forming the lever and the cam follower may be made of a metal.

(25) Although according to the above-described embodiment, the first connector and the second connector are fixed by the bolt, according to the invention, there may be constructed a constitution in which fixing means by the bolt is not provided.

(26) Although according to the above-described embodiment, the lock portion is formed only at the inner side face on the side remote from the pivoting center of the cam groove, according to the invention, the lock portion may be provided only at the inner side face on the side proximate to the pivoting center, or may be provided to both of the inner side face on the side remote from the pivoting center and the inner side face on the side proximate to the pivoting center.

What is claimed is:

1. A connecting structure of a connector, comprising:

a first connector having a housing for containing a plurality of terminal metal pieces connected to a plurality of wires, and an electrically conductive shield shell including a hood portion projected to a front side and surrounding the housing, the shield shell is electrically connected with an electrically conductive shield member surrounding the plurality of wires; and a second connector capable of being fitted to the first connector, the second connector having a housing capable of containing a plurality of terminal metal pieces and capable of being fitted to the housing of the first connector and an electrically conductive shield shell surrounding the housing;

wherein at least one of the shield shell of the first connector and the shield shell of the second connector is made by diecasting; and wherein one of the shield shells of the first connector and the second connector is fitted to the other of the shield shells to be along an inner periphery or an outer periphery of the other of the shield shells in a state that the first connector and the second connector are fitted to each other.

2. The connecting structure of a connector according to claim 1, wherein the housing surrounded by the shield shell made by diecasting is provided with a rattling restricting portion capable of restricting the housing from being rattled in a direction intersecting with a direction of drawing a die relative to the shield shell by being brought into contact with a position of the inner periphery of the shield shell having a highest dimensional accuracy in the direction of drawing the die for diecasting.

3. The connecting structure of a connector according to claim 1, wherein the shield shell of the first connector and the shield shell of the second connector are conductively fixed by a bolt in a direction intersecting with a direction of fitting the two shield shells.

4. The connecting structure of a connector according to claim 1, further comprising:

a lever supported by either one of the shield shells of the first connector and the second connector; and a cam follower provided on the other of the shield shells;

wherein the two connectors are fitted to each other by pivoting the lever to a fitting position in a state of engaging the cam follower to a cam groove of the lever; and wherein the cam groove is formed with a lock portion for restricting the cam follower from being displaced in a returning direction thereof by being engaged with the cam follower in a state that the lever is moved to the fitting position.

5. A shield connector to be integrated to a counter side connector including a counter side housing for containing a plurality of counter side terminals and an electrically conductive counter side shield shell surrounding the counter side housing, the shield connector comprising:

a housing for containing a plurality of terminal metal pieces connected to a plurality of wires; and an electrically conductive shield shell made by diecasting including a hood portion projected to a front side and surrounding the housing, the shield shell is electrically connected with an electrically conductive shield member surrounding the plurality of wires;

wherein in a state of being connected to the counter side connector, one of the shield shell and the counter side shield shell is fitted to the other to be along an inner periphery or an outer periphery of the other.

6. The shield connector according to claim 5, wherein the housing is provided with a rattling restricting portion capable of restricting the housing from being rattled in a direction intersecting with a direction of drawing a die relative to the shield shell by being brought into contact with a position of the inner periphery of the shield shell having a highest dimensional accuracy in the direction of drawing the die for diecasting.

7. The shield connector according to claim 5, wherein the shield shell and the counter side shield shell are conductively fixed by a bolt in a direction of intersecting with a direction of fitting the two shield shells.

8. The shield connector according to claim 5, further comprising:

a lever supported by the shield shell;

wherein the shield connector is connected to the counter side connector by pivoting the lever to a fitting position in a state of engaging a cam follower provided at the counter side shield shell to a cam groove of the lever; and wherein the cam groove is formed with a lock portion for restricting the cam follower from being displaced in a returning direction thereof by being engaged with the cam follower in a state that the lever is moved to the fitting position.

9. A lever type connector comprising:

a first connector having a housing for containing a terminal metal piece and an electrically conductive shield shell made by diecasting for surrounding the housing, the shield member electrically connecting to an electrically conductive shield member surrounding a plurality of wires;

a lever supported by the shield shell in a movable manner, the lever having a cam groove; and a second connector having a cam follower;

wherein by moving the lever to a fitting position in a state of engaging the cam follower with the com groove, the second connector is attracted to the first connector to fit the two connectors to each other; and wherein the cam groove is formed with a lock portion for restricting the cam follower from being displaced in a returning direction thereof by being engaged with the cam follower in a state that the lever is at the fitting position.

10. The lever type connector according to claim 9, wherein the cam groove includes a first side face with which the cam follower is brought into sliding contact in accordance with pivoting the lever from the fitting position to a side of an initial position, the first side face being extended substantially linearly from an inlet of the cam groove to a depth end portion of the cam groove.

11. The lever type connector according to claim 10, wherein the second connector has a housing for containing a terminal metal piece and a shield shell for surrounding the housing and the shield shell is formed with the cam follower; and wherein in a state that the two connectors are fitted, either one of the shield shell of the first connector and the shield shell of the second connector overlaps to surround other thereof and the two fitted shield shells are conductively fixed by a bolt in a direction substantially orthogonal to a fitting direction.

12. The lever type connector according to claim 9, wherein the cam groove includes a second side face with which the cam follower is brought into sliding contact in accordance with pivoting the lever from a side of an initial position to the fitting position, the second side face having substantially an arc shape and formed with the lock portion.

13. The lever type connector according to claim 12, wherein the lock portion is located in the vicinity of a depth end portion of the cam groove.

14. The lever type connector according to claim 13, wherein the lock portion has substantially a triangular shape.

* * * * *